US006782791B2

(12) United States Patent
Moore

(10) Patent No.: US 6,782,791 B2
(45) Date of Patent: Aug. 31, 2004

(54) SEMIAUTOMATIC OR AUTOMATIC GUN

(76) Inventor: Kim Ira Moore, 2008 Haven Pl., Newport Beach, CA (US) 92663

( * ) Notice: Subject to any disclaimer, the term of this patent is extended or adjusted under 35 U.S.C. 154(b) by 0 days.

(21) Appl. No.: 10/308,642

(22) Filed: Dec. 2, 2002

(65) Prior Publication Data

US 2004/0103777 A1 Jun. 3, 2004

(51) Int. Cl.[7] ..... F41A 19/47

(52) U.S. Cl. ..... 89/1.4; 89/1.42; 89/193; 89/43.01; 89/44.01

(58) Field of Search ..... 89/1.4, 1.42, 193, 89/43.01, 44.01

(56) References Cited

U.S. PATENT DOCUMENTS

| | | | | |
|---|---|---|---|---|
| 2,454,885 A | * | 11/1948 | Robinson, Jr. | 42/16 |
| 2,458,647 A | * | 1/1949 | Sampson et al. | 42/16 |
| 3,566,744 A | | 3/1971 | Stoner | 89/125 |
| 3,690,218 A | | 9/1972 | Maillard | 89/185 |
| 3,722,123 A | * | 3/1973 | Parisi | 42/16 |
| 4,056,038 A | * | 11/1977 | Rath | 89/128 |
| 4,358,986 A | | 11/1982 | Giorgio | 89/142 |
| 4,475,438 A | | 10/1984 | Sullivan | 89/191 R |
| 4,502,367 A | | 3/1985 | Sullivan | 89/181 |
| 4,553,469 A | | 11/1985 | Atchisson | 89/191.02 |
| 4,715,139 A | * | 12/1987 | Rodney, Jr. | 42/51 |
| 4,766,800 A | | 8/1988 | Miller et al. | 89/33.02 |
| 4,930,399 A | | 6/1990 | Trevor, Jr. | 89/191.02 |

FOREIGN PATENT DOCUMENTS

| | | | | |
|---|---|---|---|---|
| GB | 723954 | * | 2/1955 | 89/1.4 |

* cited by examiner

*Primary Examiner*—Stephen M. Johnson
(74) *Attorney, Agent, or Firm*—Dennis W. Beech

(57) ABSTRACT

The gun may have a receiver element with a barrel extending forwardly from the receiver element with the barrel having a chamber end and a discharge end. A handle element may be attached to the receiver element and a trigger assembly may be integrated with the handle element. The receiver element may have a bolt carrier chamber formed therein and a bolt carrier assembly slidably disposed in the bolt carrier chamber. The bolt carrier chamber at a rearward portion thereof and the bolt carrier assembly may define a gas chamber. A bolt assembly may be slidably disposed in the bolt carrier assembly. An actuator may be slidably engaged with the receiver element and may be engageable with the bolt carrier assembly and the bolt assembly. A firing pin assembly may be slidably disposed in said bolt assembly and may have a firing assembly in communication with said trigger assembly.

45 Claims, 29 Drawing Sheets

SEMIAUTOMATIC OR AUTOMATIC GUN

BACKGROUND OF THE INVENTION

This invention relates to guns such as large caliber guns as well as firearms that may be automatic or semiautomatic that may include recoil mechanisms, firing mechanisms, safety devices, replaceable barrels and the other elements associated with guns. The new device may include a gas recoil mechanism, a firing mechanism without a hammer, a bolt safety mechanism, one or more safety trigger devices, a replaceable barrel and handle mechanism as well as the other elements associated with a gun.

Efforts to design an improved, practical and reliable automatic loading gun or firearm generally have made guns that may be temporarily unstable due to the effects of the firing recoil, or have inadequately considered the effects of recoil when designing the gun or cannon. Most known automatic or semiautomatic weapons, regardless of the caliber, that are in commercial use have a gas operated bolt release or a simple heavy spring recoil that operates the recoil through the discharge of the high pressure gasses or inertia created through the explosion of the round in the barrel.

The high pressure gases that may be produced inside the barrel of a weapon after the round is detonated and during the fraction of a second that the projectile is escaping through the barrel, or through the force of the explosion, force the spent cartridge to push the bolt towards the rear of the weapon. Usually a standard simple spring may be used to slow the bolt down and start to force the bolt back forward again to engage another round to load the weapon and complete the cycle. Many weapons may use a small tube to collect the spent high pressure gasses from the barrel, which in turn unlock and then blow-back the bolt toward the rear of the weapon to begin the recoil cycle.

The terms automatic, semiautomatic or full automatic loading generally denote a firearm that when fired automatically ejects the spent round, cartridge, or shell and then loads a fresh round from a magazine. This may include semiautomatic as well as full automatic firing modes of operation. Recoil may affect all firearms to some degree, but the relatively heavy recoil, especially with large caliber rounds, of current weapon designs is recognized and compensated for by most shooters or operators. Particularly in larger-gauge weapons, recoil may cause discomfort, loss of aiming accuracy and, in the case of automatic loading weapons, prevent effectively tracking a target with repeated fire, especially at long range while using a telescope.

The undesirable effects of heavy recoil are particularly troublesome when designing and using weapons intended for full automatic fire, often designated as assault weapons. This may also be a problem for sniper weapons. Law enforcement and military agencies have long sought and desired the close and long range intimidating effects of a universal weapon that may be capable of selective semiautomatic and full automatic firing, but that may have quick reliable repeated reloading and low recoil effect.

Existing weapons generally include some form of a hammer mechanism for activating the firing pin. The designs generally use the energy of the rearward motion of the bolt or other mechanism to cock the hammer or like apparatus. Using a weapon that does not require a hammer may reduce the amount of weapon motion caused when the trigger is pulled. A firearm may be fired from a closed bolt position such that when the operator pulls the trigger there may be no movement in the firearm other than the firing pin motion until the firing pin strikes directly against the round. This may eliminate the presently known trigger designs that may release a hammer that then strikes the firing pin that hits the primer of the round. Eliminating the hammer may eliminate one extra movement and thereby one less chance the operator may miss the target.

Existing guns may include trigger safety devices to prevent inadvertent firing as well as mechanisms to fire in semiautomatic or automatic modes of operation. There may also be mechanisms to prevent the firing pin from striking a round in the firing chamber as a safety precaution. Further, guns may have provision for replacement of the barrel in a relative efficient disconnect manner.

SUMMARY OF THE INVENTION

The present invention is directed to guns for semiautomatic or automatic firing. The gun may have a receiver element with a barrel extending forwardly from the receiver element with the barrel having a chamber end and a discharge end. A handle element may be attached to the receiver element and a trigger assembly may be integrated with the handle element. The receiver element may have a bolt carrier chamber formed therein and a bolt carrier assembly slidably disposed in the bolt carrier chamber. The bolt carrier chamber at a rearward portion thereof and the bolt carrier assembly may define a gas chamber. A bolt assembly may be slidably disposed in the bolt carrier assembly. An actuator may be slidably engaged with the receiver element and the actuator may be engagable with the bolt carrier assembly and the bolt assembly. A firing pin assembly may be slidably disposed in said bolt assembly and may have a firing assembly in communication with said trigger assembly. An ammunition source may be attachable to the receiver element and a foregrip handle may be attachable to the gun. The gun may have an adjustable gas pressure assembly, a barrel locking mechanism and a barrel engagement assembly.

These and other features, aspects and advantages of the present invention will become better understood with reference to the following drawings, description and claims.

DETAILED DESCRIPTION

Figure 1:
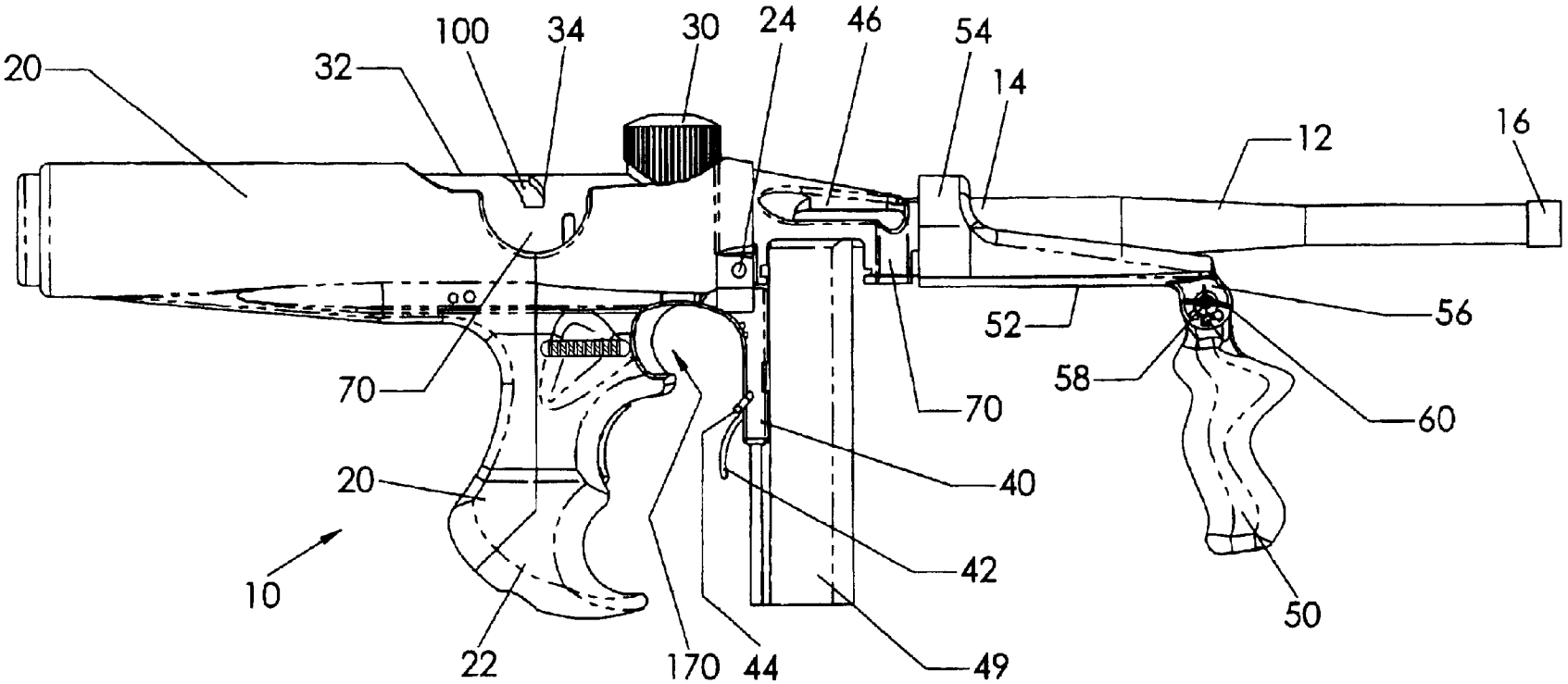
FIG. 1 illustrates a right side elevation view of the gun according to an embodiment of the invention.
Figure 2:
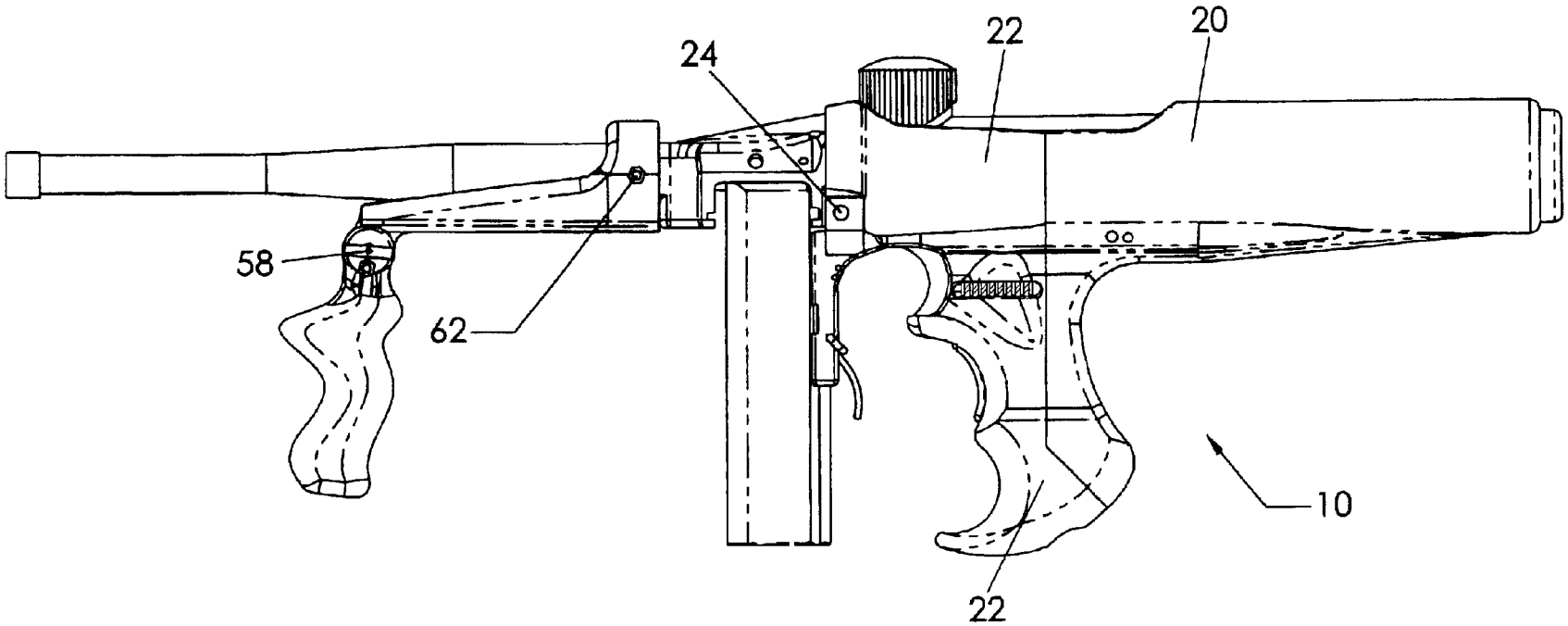
FIG. 2 illustrates a left side elevation view of the gun according to an embodiment of the invention.
Figure 3:
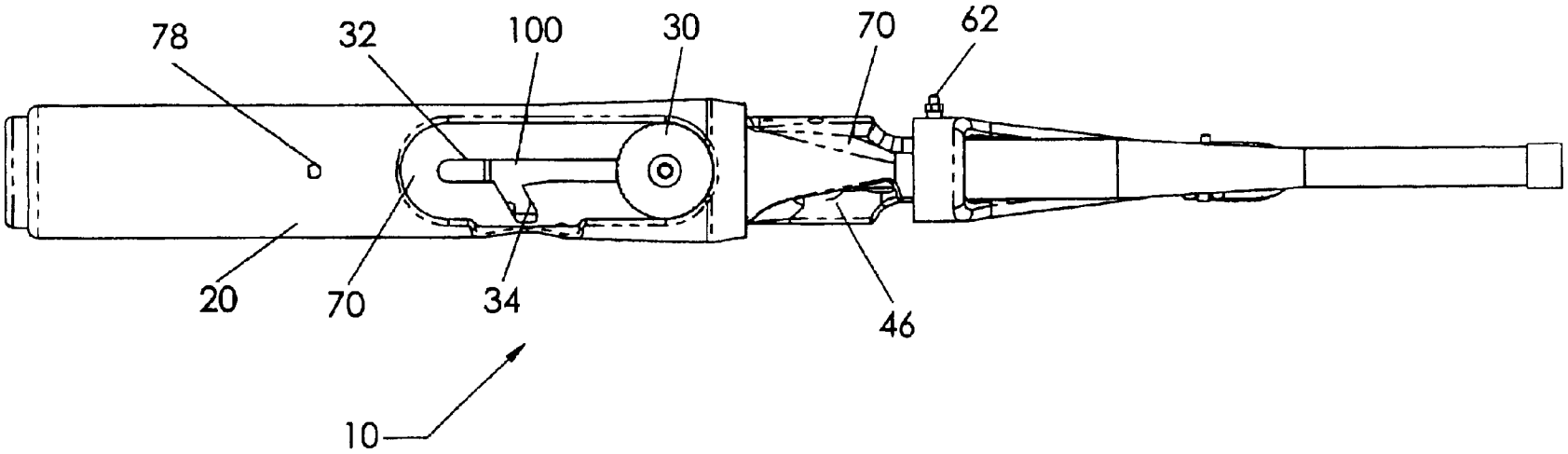
FIG. 3 illustrates a top view of the gun according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 3 and 26, the gun 10 may have a receiver element 70 that may have a barrel 12 extending forwardly from the receiver element 70. The barrel 12 may have a chamber end 14 and a discharge end 16. There may be a handle element 20 attached to the receiver element 70 and there may be a trigger assembly 170 integrated into a trigger housing 22 that may be attached to the handle element 20. A handle locking pin bore 24 may be formed in the trigger housing 22 and the receiver element 70 for attachment thereof by for example a clevis pin (not shown).

An actuator 30 may be slidably engaged in an actuator slot 32 of the receiver element 70 for forward and rearward movement while engaged with a bolt carrier assembly 100 in order to manually cock the gun 10 for loading, clearing or firing. There may also be an actuator lock slot 34 for receipt of the actuator 30 to hold the bolt carrier assembly 100 in an open position.

The gun 10 may also have a magazine attachment 40 that may have a magazine retainer 42 and there may be a casing eject slot 46. There may also be a foregrip arm 52 having a foregrip collar 54 attached to the receiver element 70. A foregrip handle 50 may be rotatably attached to the foregrip arm 52 at a pivot point 56 using a foregrip screw 58 and wingnut 60. The foregrip collar 54 may be rotationally attached to the receiver element 70 and fixed in place with a position pin 62, having a biasing spring, inserted in a position hole 64 as best viewed in FIG. 5. There may be multiple position holes 64 to allow rotation and fixing of the foregrip collar 54 thereby setting the foregrip handle 50 in a variety of positions in a 360 degree range around the barrel 12 longitudinal axis for use in holding the gun 10 when in use. Alternatively there may be a handle 310.

Figure 4:
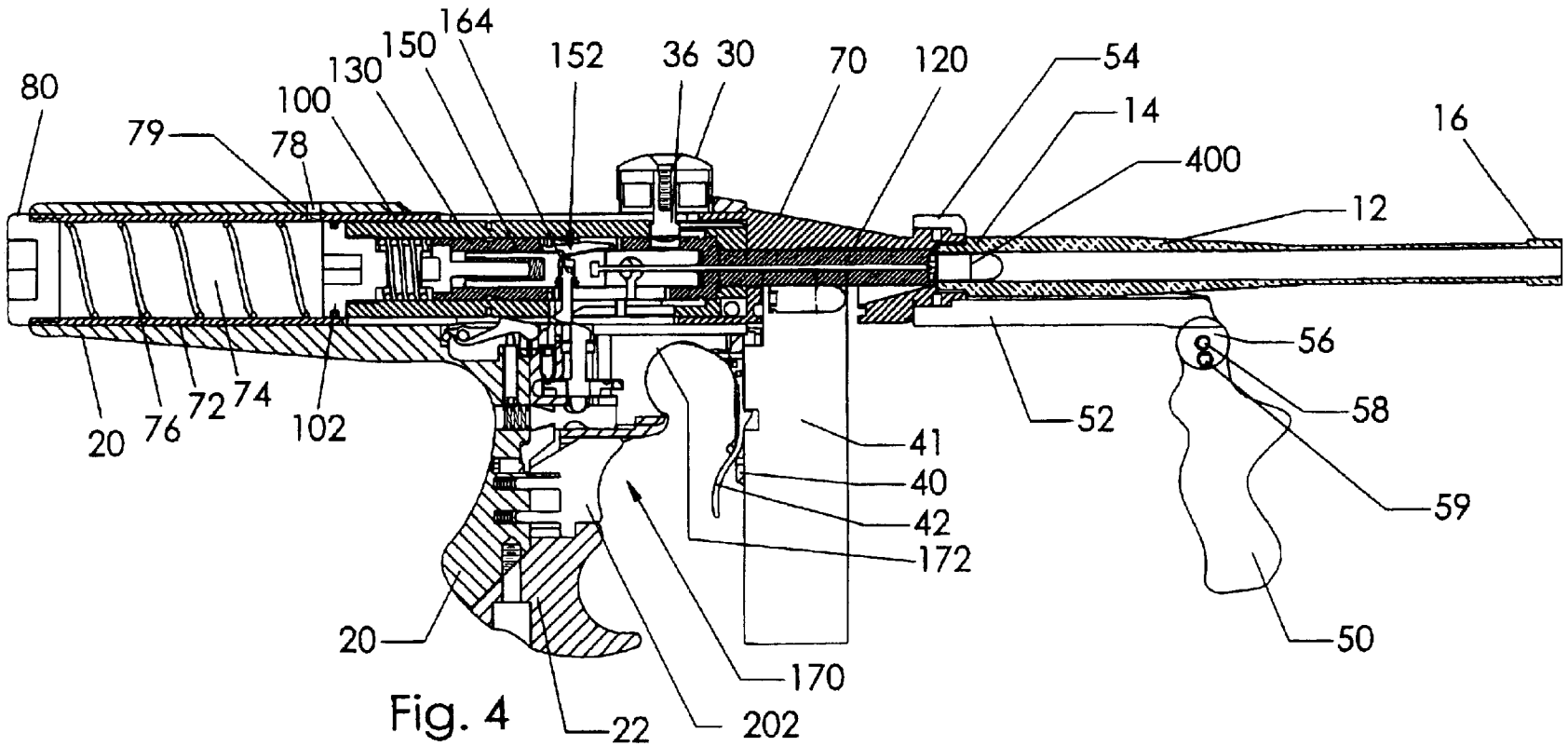
FIG. 4 illustrates a right side cross sectional elevation view of the gun according to an embodiment of the invention.
Figure 5:
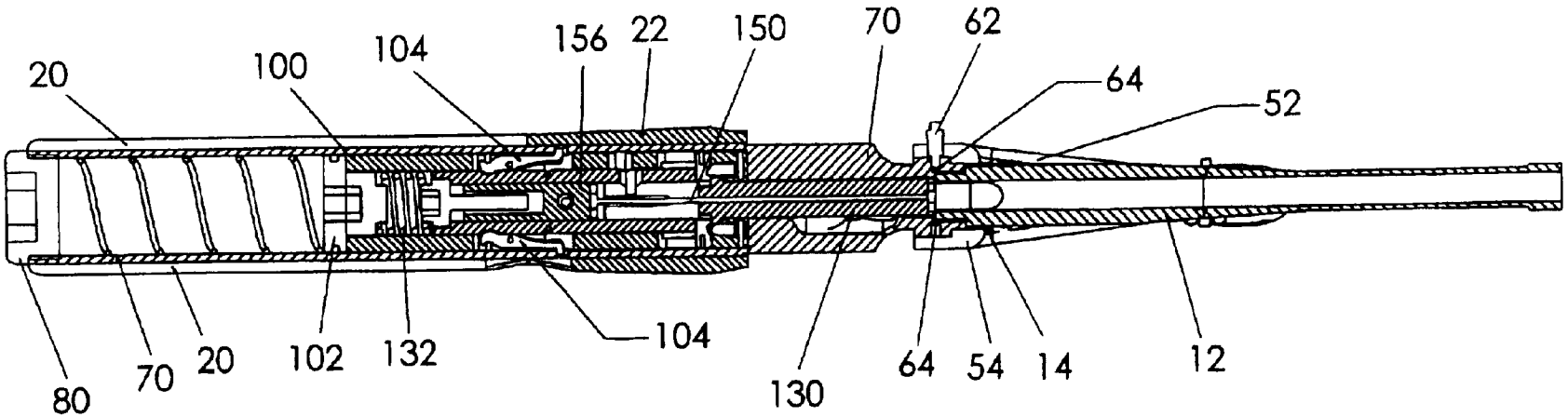
FIG. 5 illustrates a top cross sectional view of the gun according to an embodiment of the invention.

Referring to FIGS. 4 and 5, a bolt carrier assembly 100 may be slidably disposed in a bolt carrier chamber 72 internal to the receiver element 70. The bolt carrier chamber 72 may have a gas chamber 74 at a rearward portion of the bolt carrier chamber 72 with a gas contained therein. The gas chamber 74 may be formed by the bolt carrier chamber 72 having a receiver cap 80 at a rearmost end and a bolt carrier plug 102 of the bolt carrier assembly 100. A gas chamber spring 76 may be disposed in the gas chamber 74. There may be a gas port 78 that may have an gas port valve 79 in the receiver element 70 in communication between the gas chamber 74 and the external environment. The air port 78 may be positioned adjacent the rear portion of the bolt carrier plug 102 when the bolt carrier assembly 100 is at its forward most position in the bolt carrier chamber 72.

The bolt carrier assembly 100 may have a bolt assembly 130 slidably disposed therein. There may be a firing pin assembly 150 slidably disposed in said bolt assembly 130 all of which elements slide axially one relative to the other wherein the axis is that of the longitudinal axis of the gun 10 or barrel 12. This may be viewed as a telescopic action of the elements.

The firing pin assembly 150 may have a firing assembly 152 in communication with a trigger assembly 170.

Figure 6:
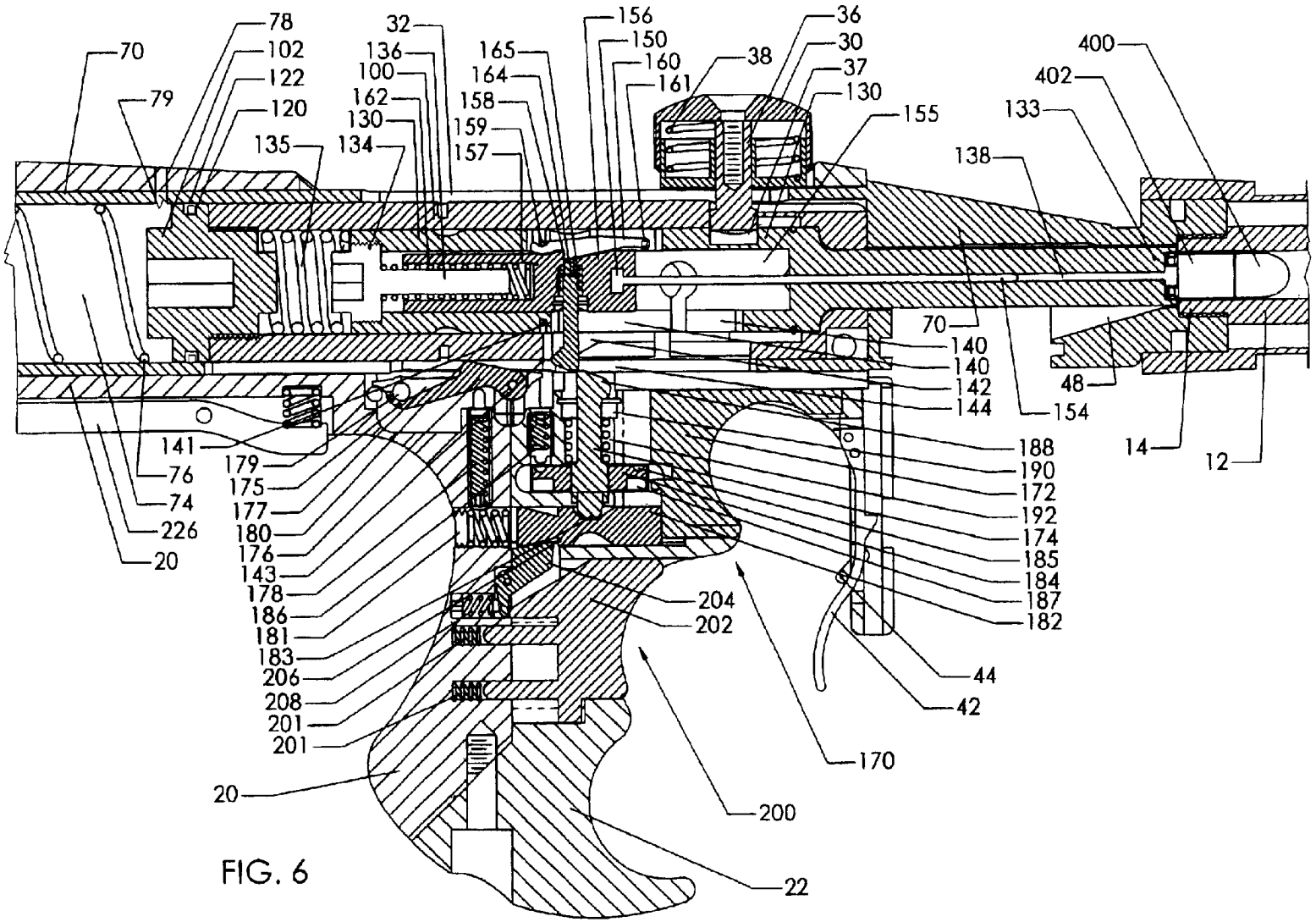
FIG. 6 illustrates a partial right side cross sectional view of the gun according to an embodiment of the invention.
Figure 7:
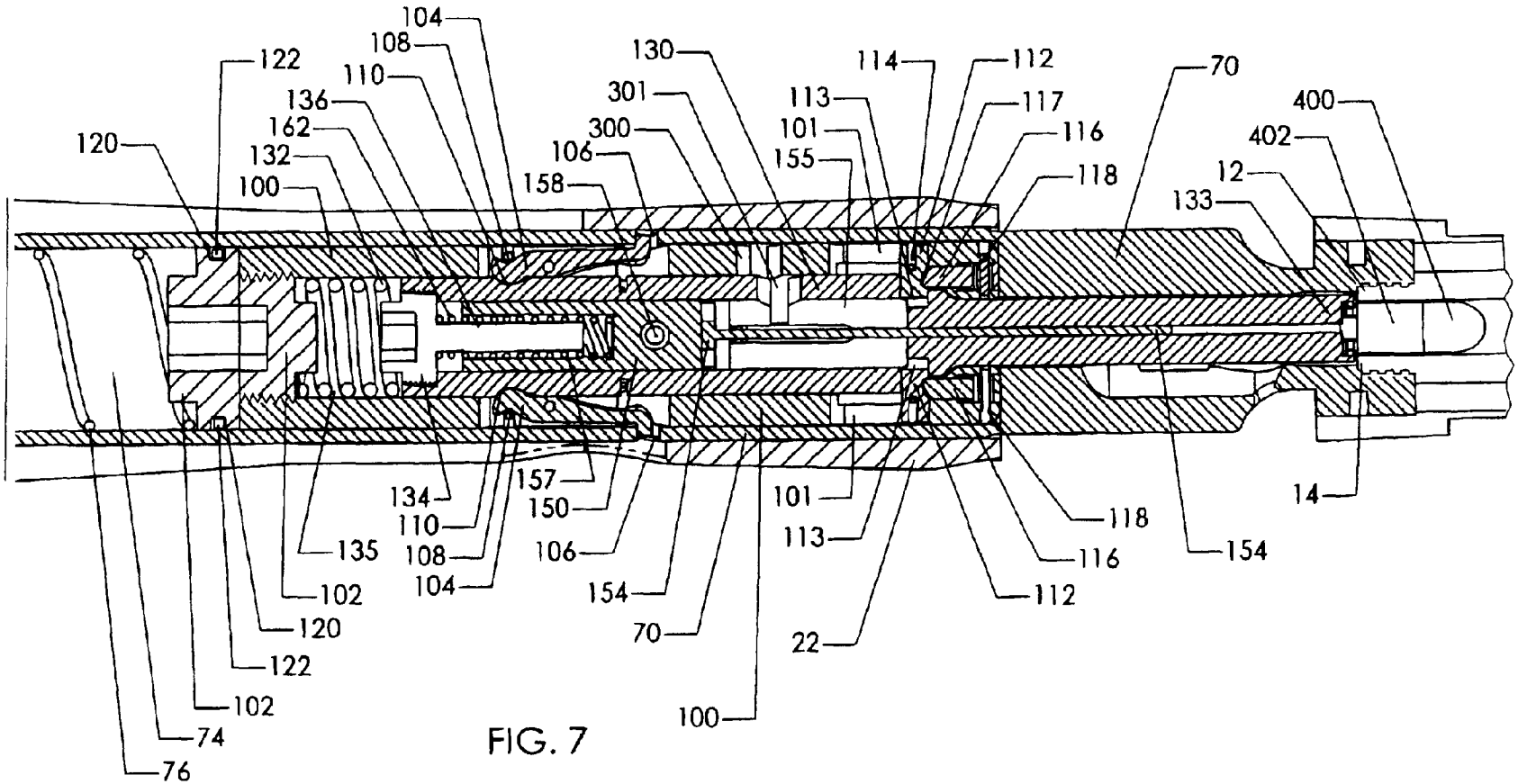
FIG. 7 illustrates a partial top cross sectional view of the gun according to an embodiment of the invention.

Referring to FIGS. 6 and 7, the bolt carrier assembly 100 may have one or more bolt catches 104 that may engage catch apertures 106 in receiver element 70 to lock bolt carrier assembly 100. Catch springs 108, that may be an annular O ring type spring, bias the bolt catches 104 to engage the catch apertures 106. When catch slots 110 in bolt assembly 130 may be in position for receipt of bolt catches 104, the bolt catches 104 when adjacent catch apertures 106 may engage catch apertures 106.

When the bolt assembly 130 is moved rearward in bolt carrier assembly 100 the bolt catches 104 are moved out of catch slots 110 and thereby disengage from catch apertures 106. This allows the bolt carrier assembly 100 to also move rearward. The bolt assembly 130 may be moved rearward by manual application of actuator 30 to manually cock the gun 10 or by gas pressure against bolt assembly 130 when a bullet 400 is fired in the chamber end 14 of barrel 12. The bolt assembly 130 may be moved rearward by depressing the actuator 30 against the spring force of actuator springs 38 to force actuator pin 36 into the cocking slot 37 in bolt assembly 130. Rearward force applied against actuator 30 may first move the bolt assembly 130 rearwardly thereby releasing the bolt carrier assembly 100 and allowing rearward movement thereof.

When bolt assembly 130 moves rearward on the event of a bullet 400 being fired, bolt spring 132 may absorb some recoil force. The bolt spring chamber 135 may also contain a gas to further aid in absorbing recoil force. Once bolt catches 104 may be disengaged from catch apertures 106, the bolt carrier assembly 100 may move rearward against the gas in gas chamber 74 and gas chamber spring 76 that may also absorb some recoil force. The bolt carrier plug 102 may have an annular slot 120 with a sealing ring 122 retained therein to seal against gas passing around bolt carrier assembly 100.

As the gas pressure against the bolt assembly 130 at a chamber portion 133 is relieved due to rearward motion and ejection of casing 402, the gas pressure in gas chamber 74 and force of gas chamber spring 76 may exceed the force of rearward motion and cause the bolt carrier assembly 100 to move forward to cause a new bullet 400 to be engaged and pushed through bullet chamber guide 48 or ramp into chamber end 14 by bolt assembly 130. Bolt spring 132 may force bolt assembly 130 to a forward position assuming no obstructions or safety system engagement such that bolt catch 104 is again positioned to engage catch apertures 106 to lock the bolt carrier assembly 100 in receiver element 70 to allow firing of the gun 10.

Figure 8:
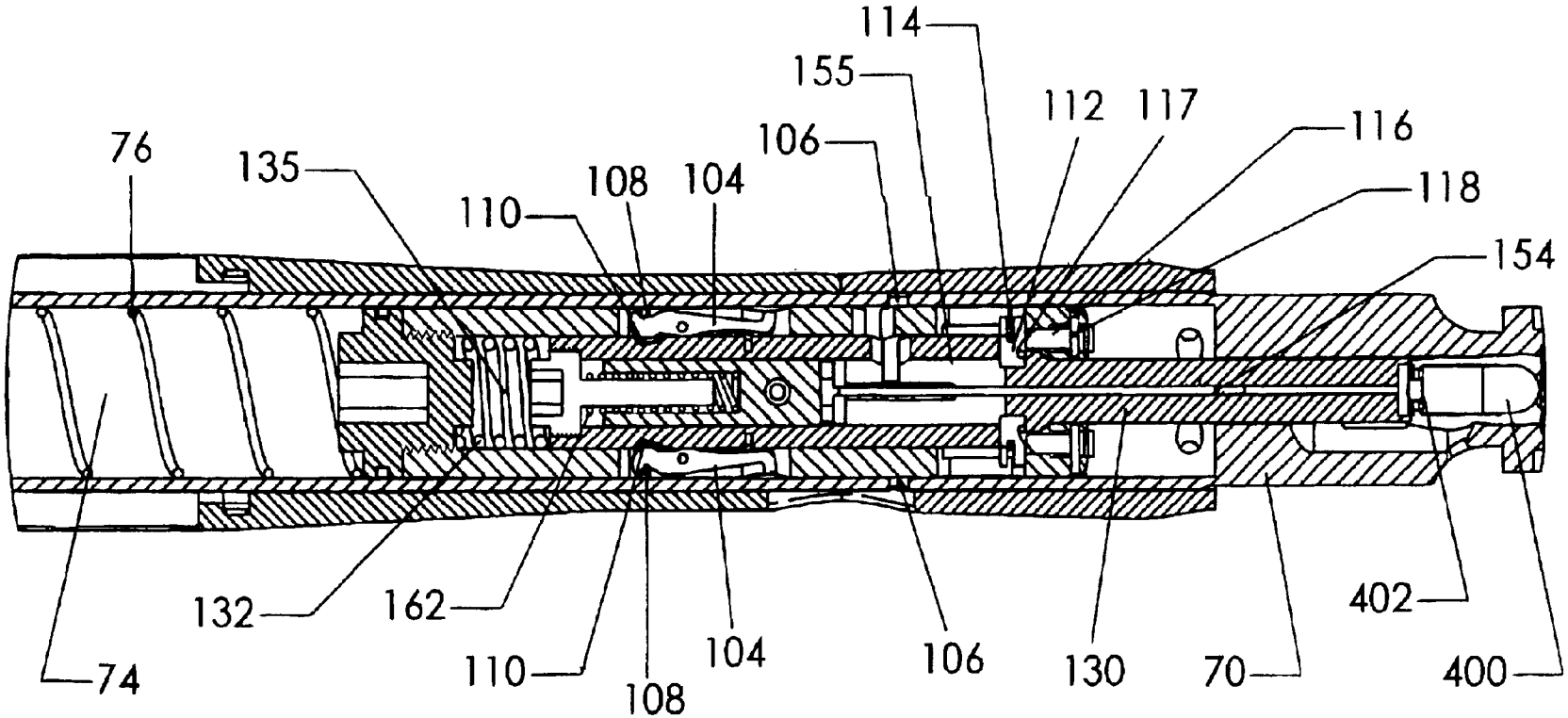
FIG. 8 illustrates a partial top cross sectional view of the gun with safety dowels in position to stop the firing pin assembly according to an embodiment of the invention.
Figure 8A:
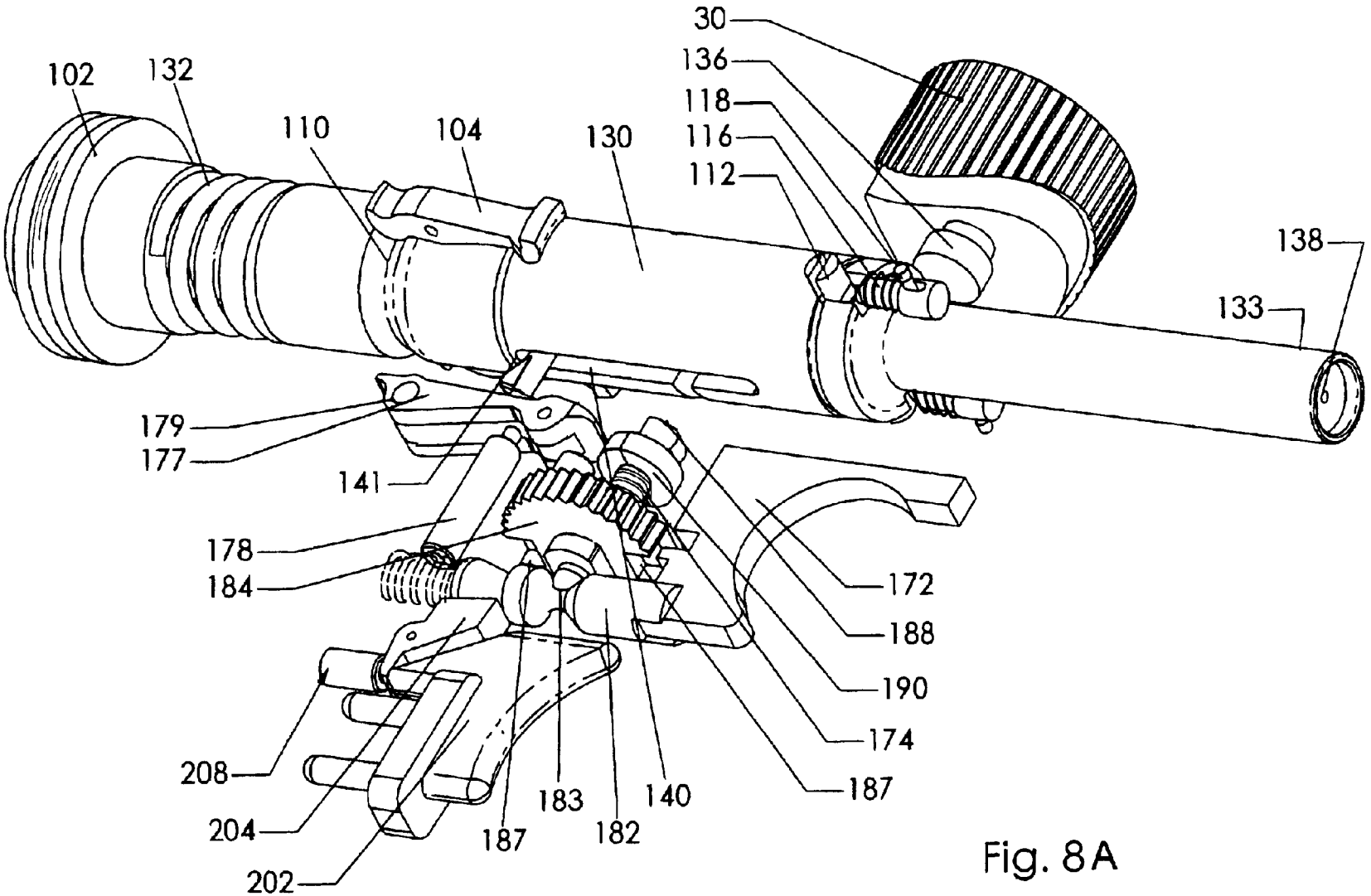
FIG. 8A illustrates a partial exploded perspective view of the bolt assembly and the trigger assembly according to an embodiment of the invention.

The bolt assembly 130 may have one or more safety dowels 112 slidably inserted in dowel apertures 113. A dowel spring 114, that may be an annular O-ring type spring, may bias safety dowel 112 to move inwardly toward firing pin 154 to protrude into firing pin chamber 155. When the safety dowel 112 is seated in dowel aperture 113 the firing pin assembly 150 may be prevented from complete forward movement in bolt assembly 130 in firing pin chamber 155, see FIG. 8. This safety feature may prevent premature firing of the gun 10 by preventing the firing pin 154 from impacting the bullet 400 prior to bolt carrier assembly 100 and bolt assembly 130 in bolt carrier assembly 100 completing full forward motion.

Dowel release pin 116 slidably disposed in bolt carrier assembly 100 may be forced into dowel slot 117 when the bolt carrier assembly 100 moves completely forward in receiver element 70. The dowel release pin 116 may force the safety dowel 112 outwardly and away from the firing pin 154 to remove the safety dowel 112 from the firing pin chamber 155. In this retracted position the firing pin assembly 150 may move completely forward in bolt assembly 130. The firing pin 154 may then impact bullet 400 to ignite the powder. The dowel release pin 116 may be retained in the bolt carrier assembly 100 by dowel pin safety screw 118. If all elements of bolt carrier assembly 100 and bolt assembly 130 are not completely forward in a safe position, the firing pin 154 may not be able to extend from bolt assembly 130. This may prevent a gun misfire.

Having described the bolt carrier assembly 100 operation for locking, firing, recoil, reloading and locking, the mechanisms to cock and fire the gun 10 may be as follows. The firing pin assembly 150 may have a firing pin housing 156 to which the firing pin 154 is attached. The firing pin housing 156 may have a firing pin lug 158 for engagement with a firing pin sear 160 rotatably mounted on firing pin near pivot 161. The firing pin sear 160 may be biased to engage firing pin lug 158 by a sear spring 159, that may be an annular O ring type spring.

When the firing pin lug 158 is engaged, the firing pin assembly 150 is cocked against firing pin spring 162 disposed between bolt plug 134 and firing pin housing 156 having a housing bore 157 therein. The bolt plug 134 may have a bolt rod 136 projecting forwardly for receipt in housing bore 157. The firing pin spring 162 may be partially disposed axially around the bolt rod 136. The firing pin assembly 150 may thereby be maintained under tension force for release to move forwardly to impact a bullet 400. Therefore, with a release of firing pin sear 160, the firing pin assembly 150 may move forwardly without any other action, such as by a hammer, thereby eliminating extra movement in the gun that may allow for accurate aiming. The firing pin housing 156 once released from the firing pin lug 158 may travel with a single movement to the point of impact with the bullet 400.

A firing actuator pin 164 may be slidably engaged in firing pin housing 156. The firing actuator pin 164 may be oriented to be pushed against firing pin sear 160 to disengage it from firing pin lug 158. This disengagement may allow the firing pin assembly 150 to move forwardly under force of firing pin spring 162 thereby causing firing pin 154 to move forwardly in firing pin channel 138 and impact bullet 400. The firing actuator pin 164 may be biased away from firing pin sear 160 by a firing actuator pin spring 165. The firing actuator pin 164 may extend through the bolt assembly 130, bolt carrier assembly 100 and receiver element 70 through bolt firing actuator pin slot 140, bolt carrier assembly firing pin actuation slot 142 and receiver firing pin actuator slot 144 therein to be engageable by a trigger assembly 170. The bolt firing pin actuator slot 140 may have a bolt firing pin support slot 141 for receipt of the firing actuator pin 164 to provide support for the forces experienced by the firing actuator pin 164 during firing of the gun. The bolt carrier assembly firing pin actuator slot 142 may also have a bolt carrier firing pin support slot 143 for support of the firing actuator pin 164. Once the gun has fired, the bolt carrier assembly 100 and other elements as described above will be forced rearwardly due to the explosion. The firing actuator pin 164 may move easily over the rollover cocking assembly 175 rotatably mounted on cocking arm assembly pivot 179 due to the gradual slope of the cocking latch 176 and the force necessary to act against cocking latch ball plunger 178.

Referring to FIGS. 6, 8A, 9 and 10, the trigger assembly 170 may move the firing actuator pin 164 with a trigger actuation pin 174 and a cocking latch 176. When trigger actuation pin 174 is urged upwardly, the firing actuator pin 164 may be forced upward and thereby disengage firing pin sear 160. The bolt carrier assembly 100 and other elements may then go through the firing sequence as described above.

Figure 10:
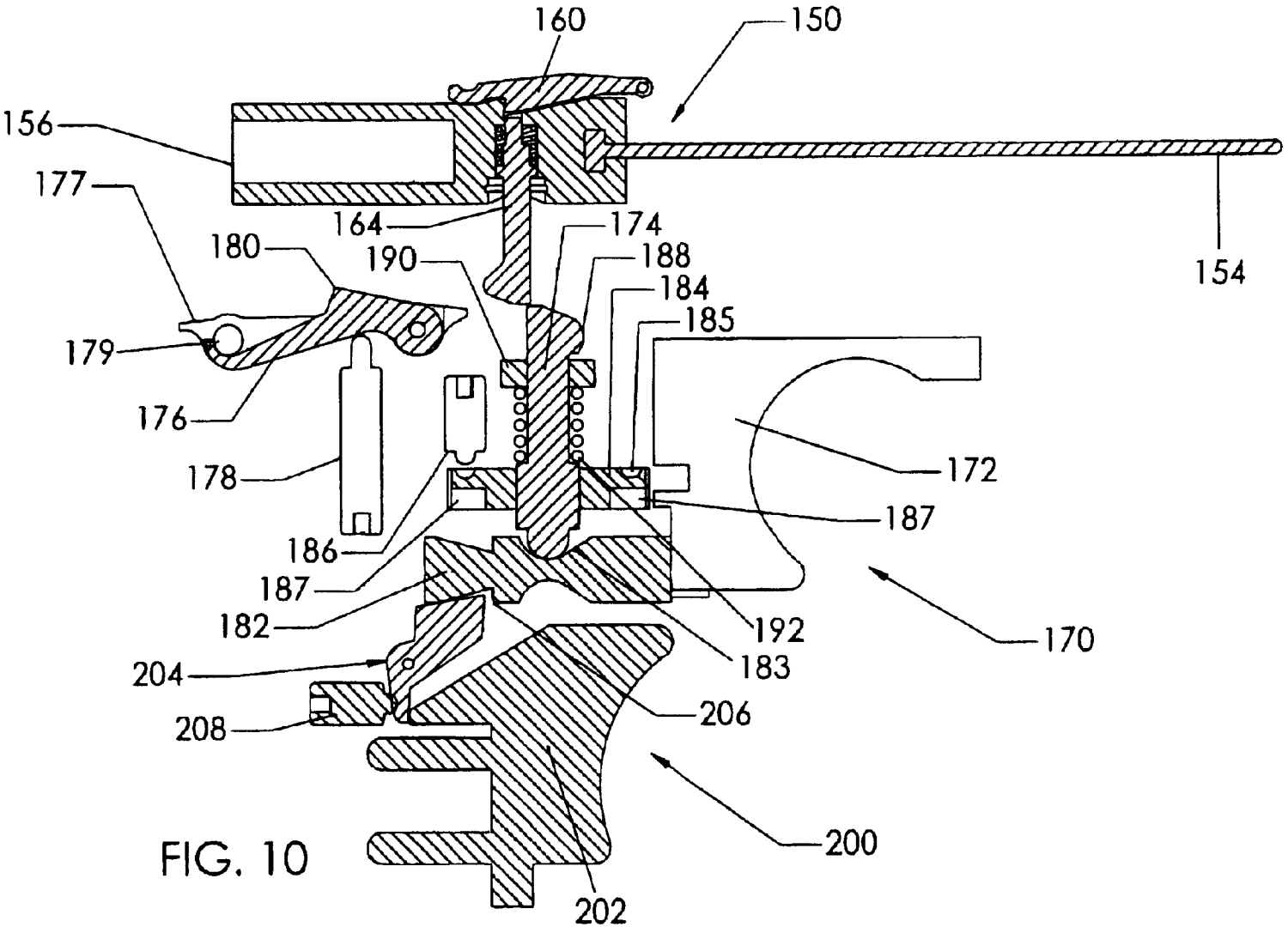
FIG. 10 illustrates a side cross sectional elevation view of the trigger assembly according to an embodiment of the invention.
Figure 11:
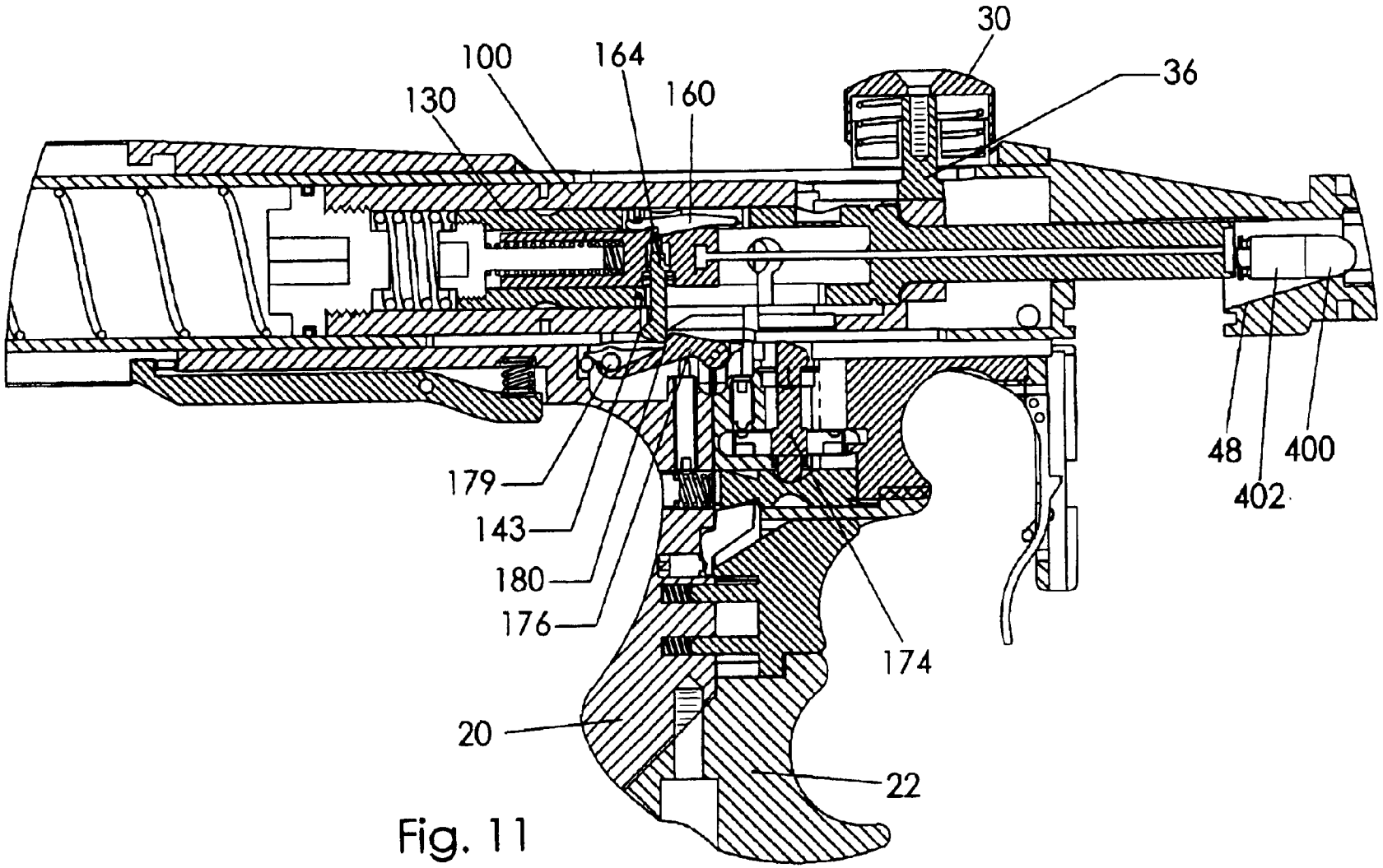
FIG. 11 illustrates a partial right side cross sectional view of the gun with the firing actuator pin engaged with the cocking latch according to an embodiment of the invention.
Figure 11A:
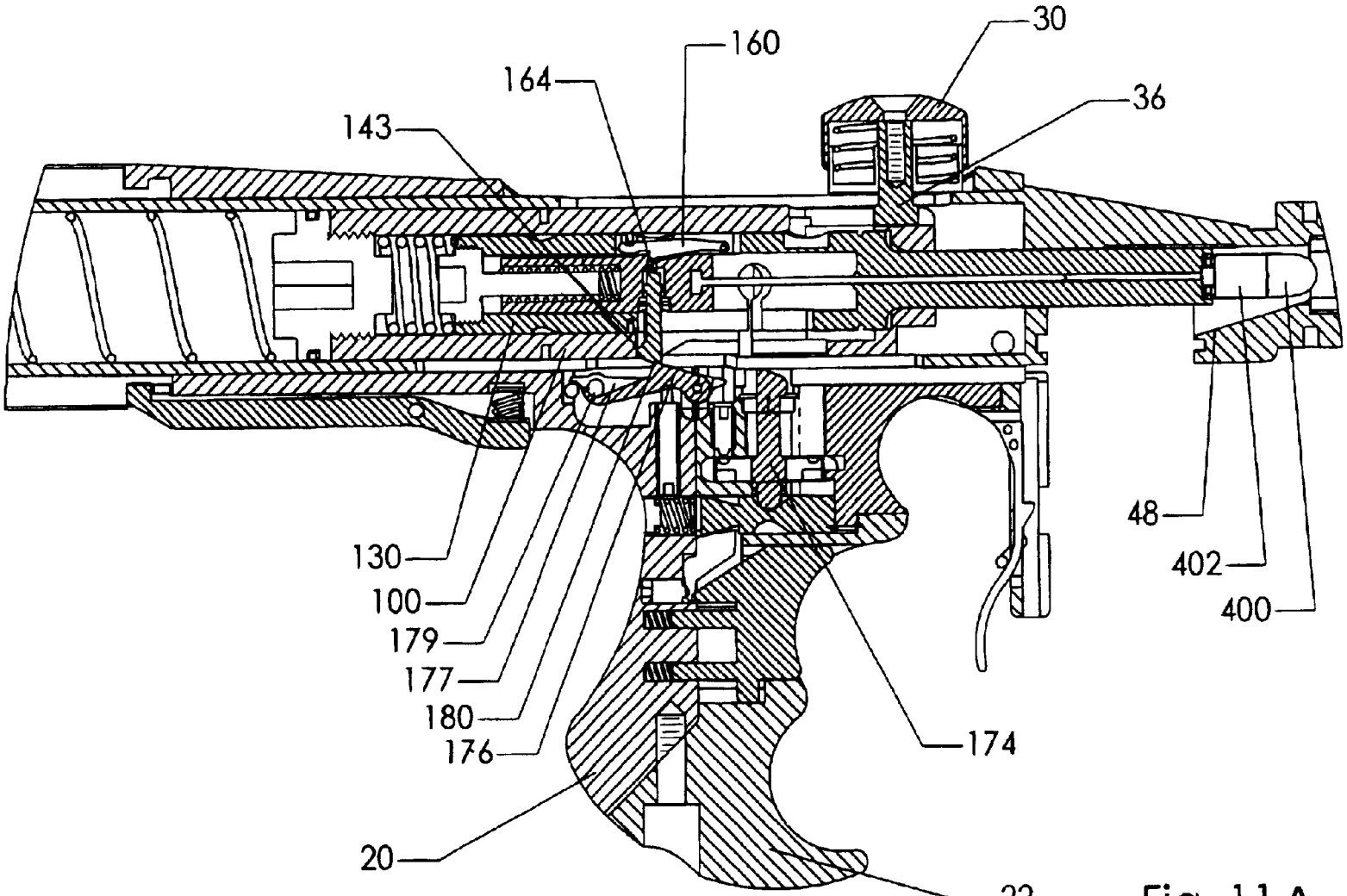
FIG. 11A illustrates a partial right side cross sectional view of the gun with the firing actuator pin partially depressing the cocking lever assembly according to an embodiment of the invention.

In addition, there may be a cocking latch 176 positioned for engagement with the firing actuator pin 164 as the bolt carrier assembly 100 moves forward to reload and fire the gun 10 as best viewed in FIG. 10. As the lower portion of the firing actuator pin 164 engages the cocking latch 176, cocking latch ball plunger 178 resists the movement of the firing actuator pin 164 past the cocking latch 176 until the firing pin assembly 150 is engaged by the firing pin sear 160 to cock the firing pin assembly 150. Then, due to the angled shape of cocking latch surface 180, the firing actuator pin 164 may force the rollover cocking assembly 175 downwardly about pivot 179 against the force of cocking latch ball plunger 178 due to the forward motion force of the bolt carrier assembly 100 and bolt carrier firing pin support slot 143. The roller cocking assembly 175 may operate with only a single force such as a spring, gas pressure, ball plunger 178 or like devices.

Referring again to FIGS. 6, 9, 10, 11 and 11A the trigger assembly 170 may have a trigger 172 that may be pulled by the users finger to urge a trigger rod 182 rearwardly against a trigger rod spring 181. The trigger rod 182 may have a trigger rod recess 183 in which the lower end of the trigger actuator pin 174 rests. As the trigger rod 182 may be moved rearwardly, the trigger actuator pin 174 that is slidably disposed in safety knob 184 and trigger actuation pin guide 190 may be urged upwardly against the force of trigger actuation pin spring 192 as it may be forced out of the trigger rod recess 183 which action may trigger the firing of the gun 10 as described above.

The orientation of the trigger actuator pin 174 may be controlled by a safety knob 184 that may be biased in place by a safety pin ball plunger 186 when positioned in a knob detent 185. As viewed in FIGS. 6, 9 and 10 the trigger actuator pin 174 is positioned for semiautomatic firing of the weapon since the forward lower edge of the firing actuator pin 164 may engage the upper back edge of the trigger actuator pin 174 if the user pulled the trigger 172 and the trigger actuator pin 174 were raised. It may then be necessary to release the trigger 172 to allow the firing actuator pin 164 to move forwardly to be positioned over the top of the trigger actuator pin 174 to again fire the weapon. The trigger actuator pin 174 interferes with the forward motion of the firing actuator pin 164 upon forward motion of the bolt carrier assembly 100 after recoil if the trigger actuator pin 174 is raised because the trigger 172 is pulled. When the trigger 172 is released to allow the trigger actuator pin 174 to move downwardly by force of trigger actuation pin spring 192, the firing actuator pin 164 may then be again positioned above trigger actuator pin 174. The firing pin sear 160 retains the firing pin assembly 150 in firing position.

Figure 12:
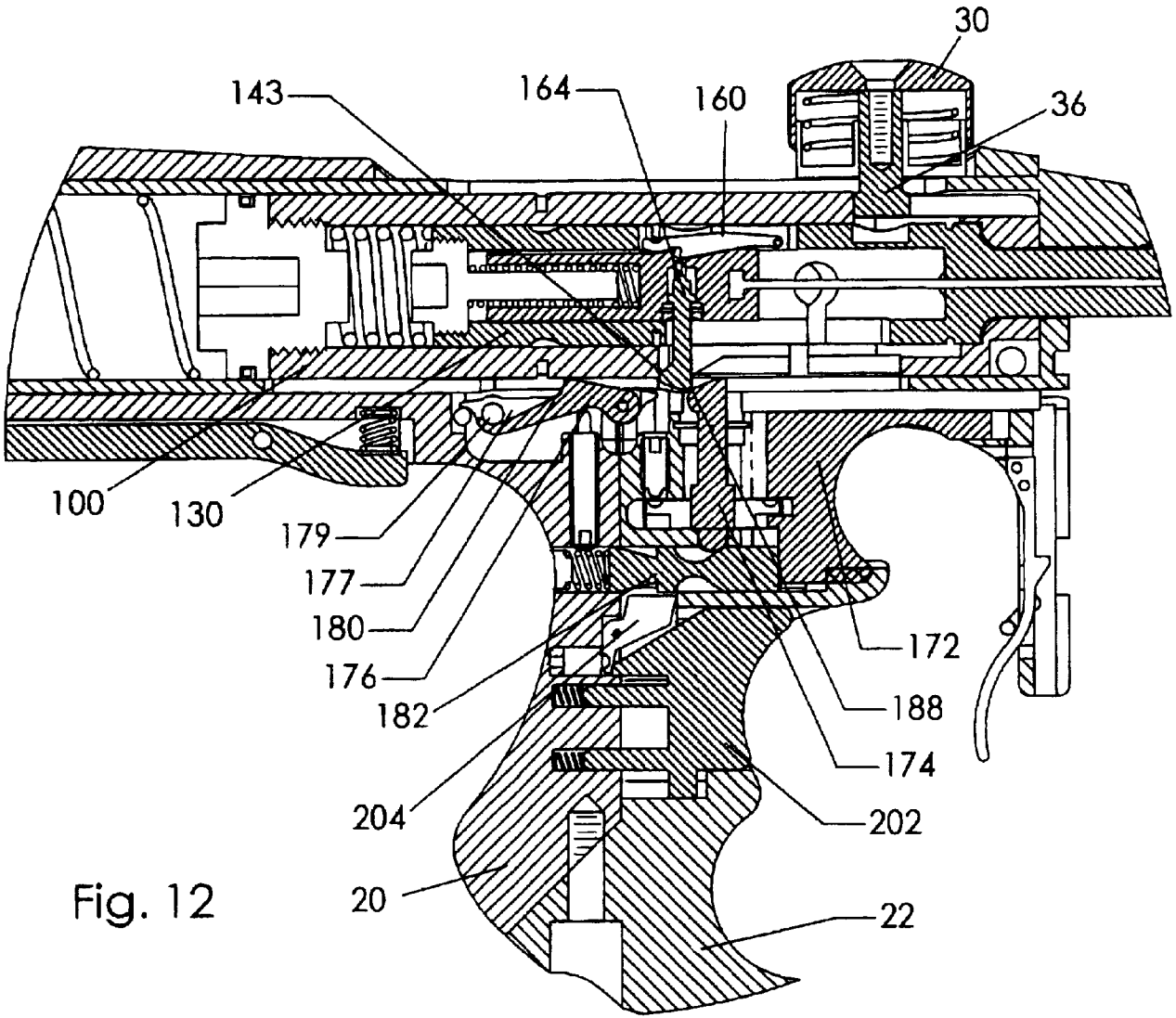
FIG. 12 illustrates a partial right side cross sectional view of the gun with the trigger actuator pin set for automatic fire according to an embodiment of the invention.
Figure 13:
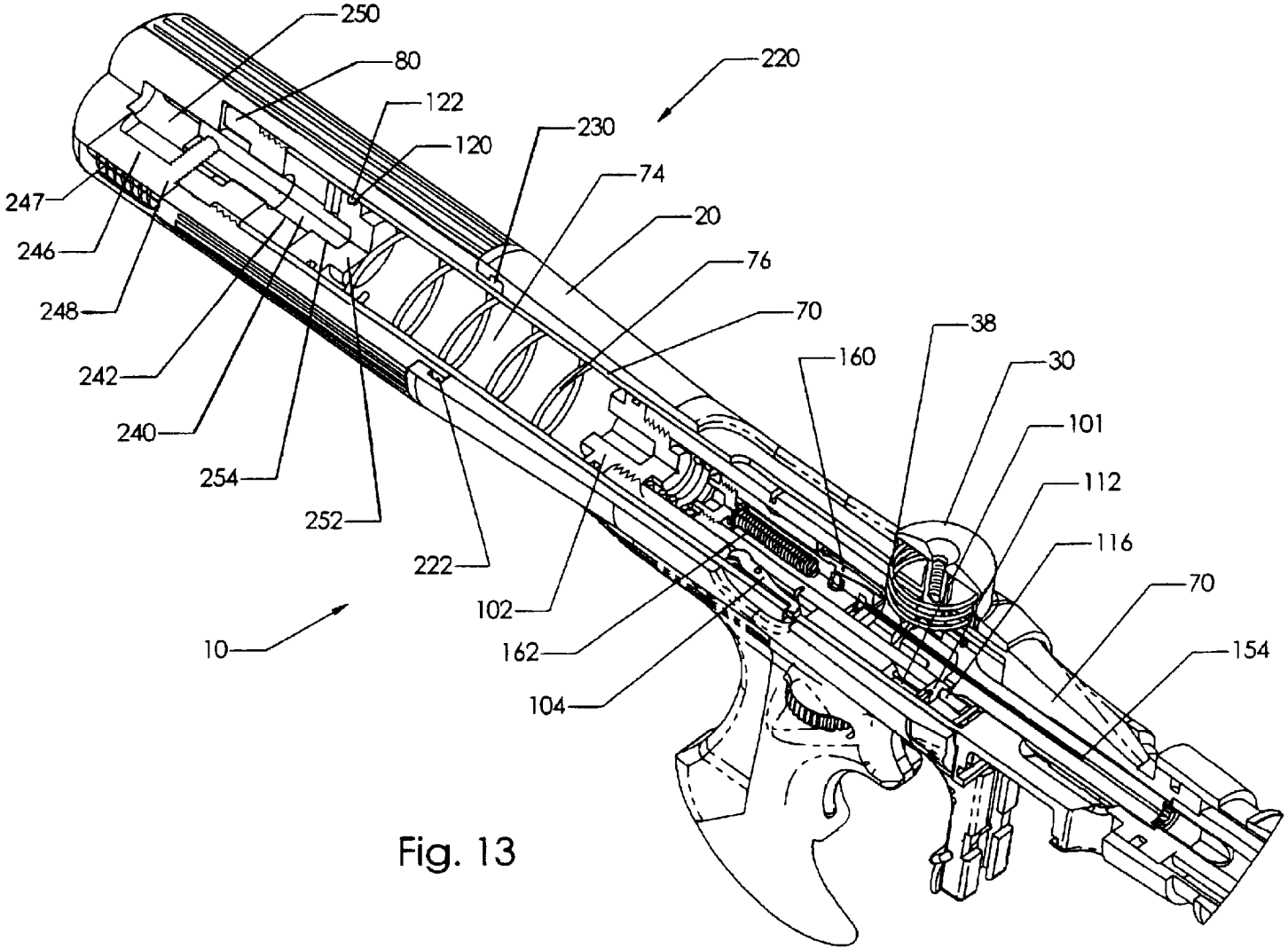
FIG. 13 illustrates a perspective partial cross sectional view of the gun according to an embodiment of the invention.
Figure 13A:
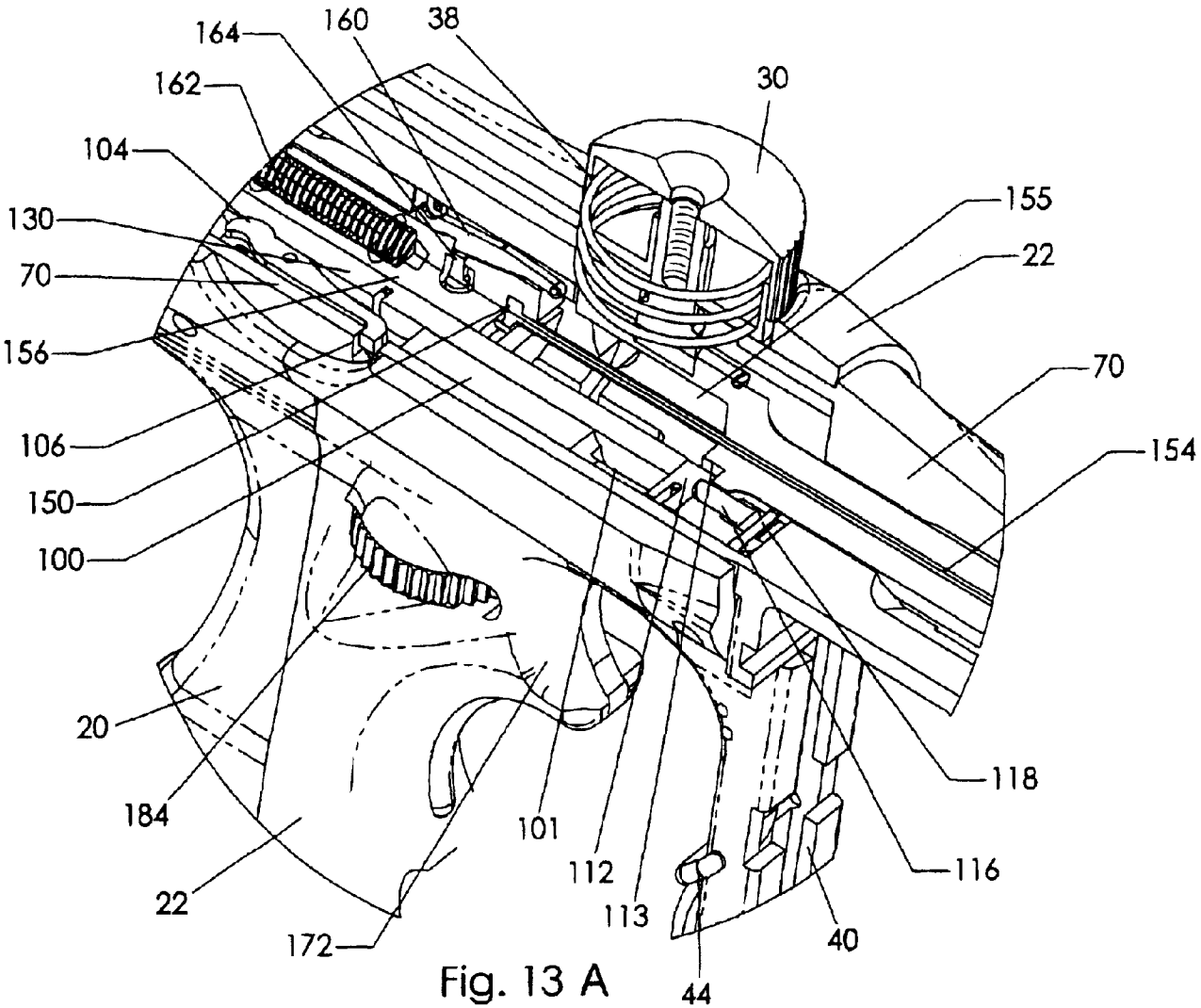
FIG. 13A illustrates a partial right side cross sectional view of the gun according to an embodiment of the invention.
Figure 14:
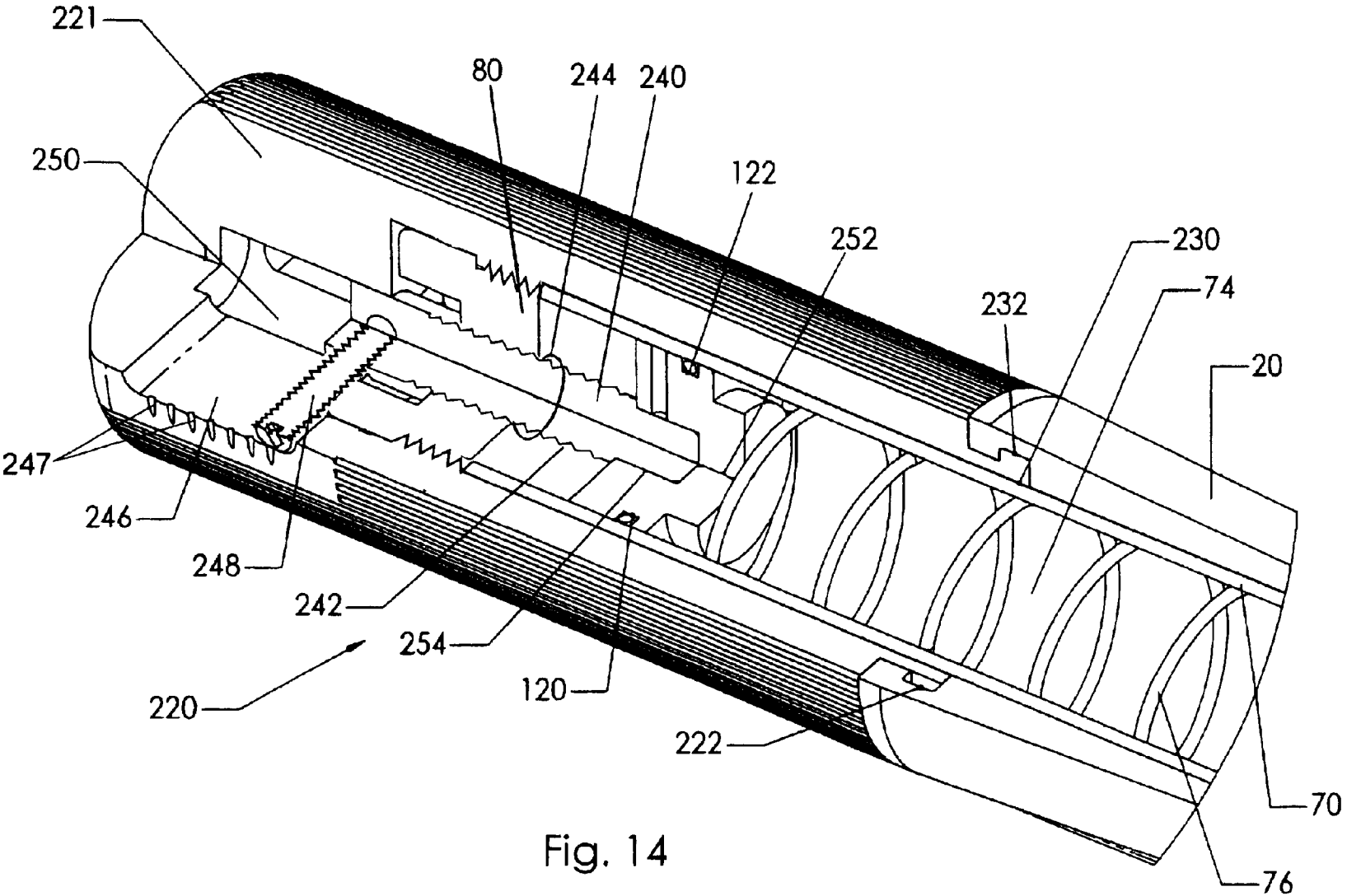
FIG. 14 illustrates a perspective partial cross sectional view of a rear portion of the gun according to an embodiment of the invention.
Figure 15:
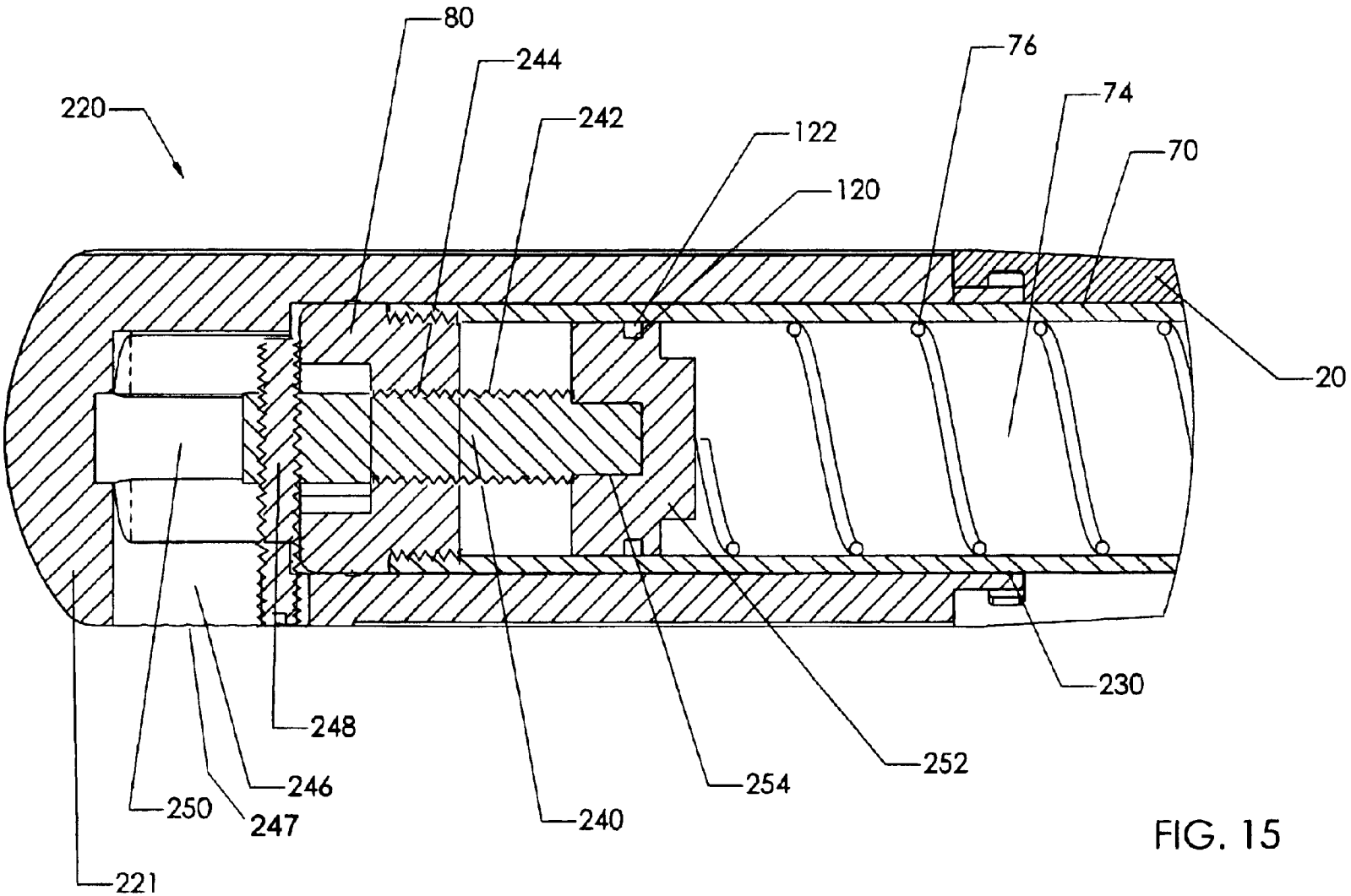
FIG. 15 illustrates a side cross sectional view of a rear portion of the gun according to an embodiment of the invention.
Figure 16:
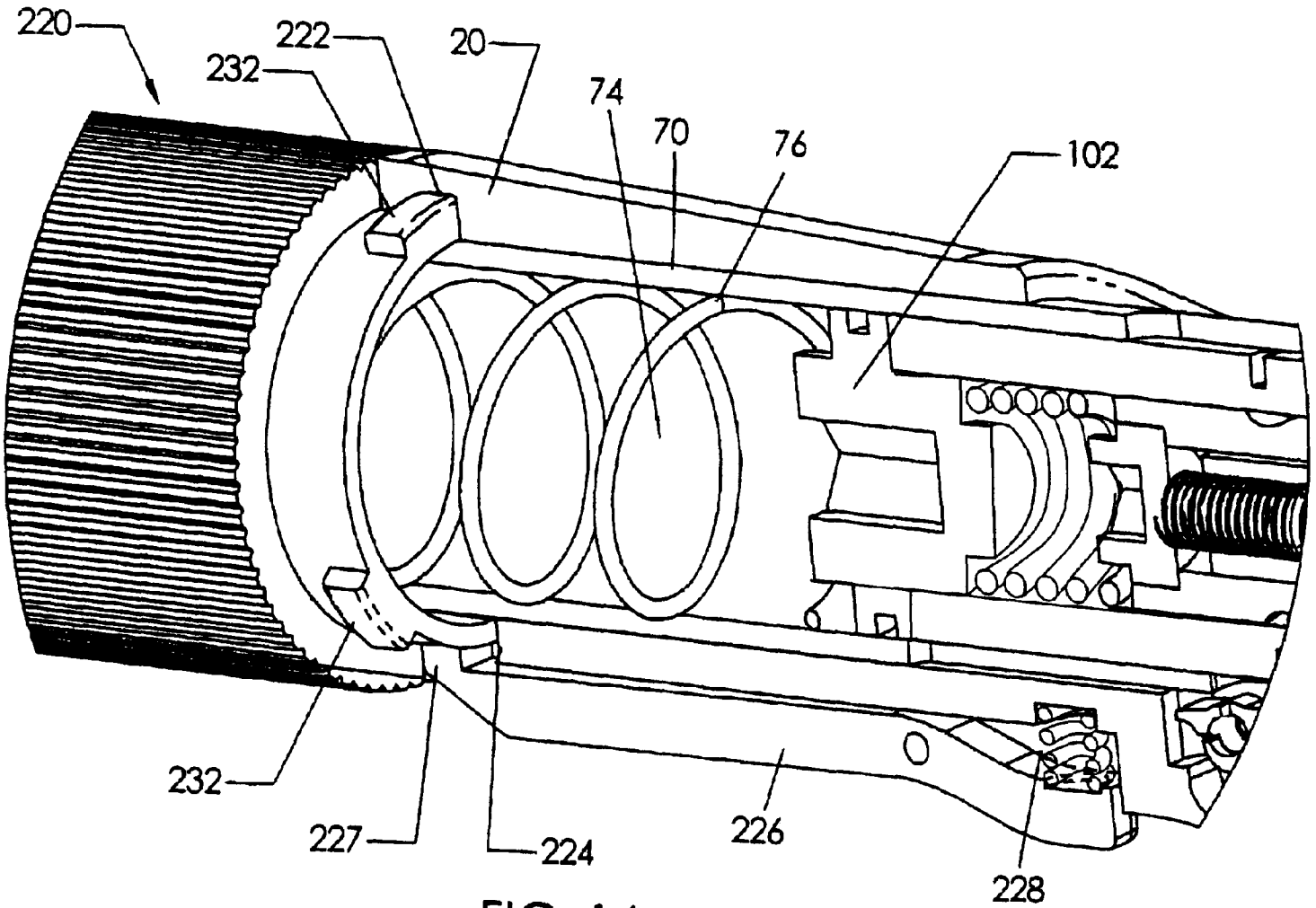
FIG. 16 illustrates a perspective cross sectional view of the engagement mechanism for the gas pressure adjustment assembly of the gun according to an embodiment of the invention.

Referring to FIG. 12, the trigger actuator pin 174 may be rotated 180° by safety knob 184 to position the front nose element 188 to face rearwardly. In this position the firing actuator pin 164 may be moved up and over the rounded front nose element 188 as the bolt carrier assembly 100 moves forwardly. If the trigger 172 is pulled by the user, the firing actuator pin 164 may be urged upwardly by the movement over the front nose element 188 to thereby engage the firing pin sear 160 of the gun 10. In this configuration the gun 10 may operate as an automatic weapon.

Figure 9:
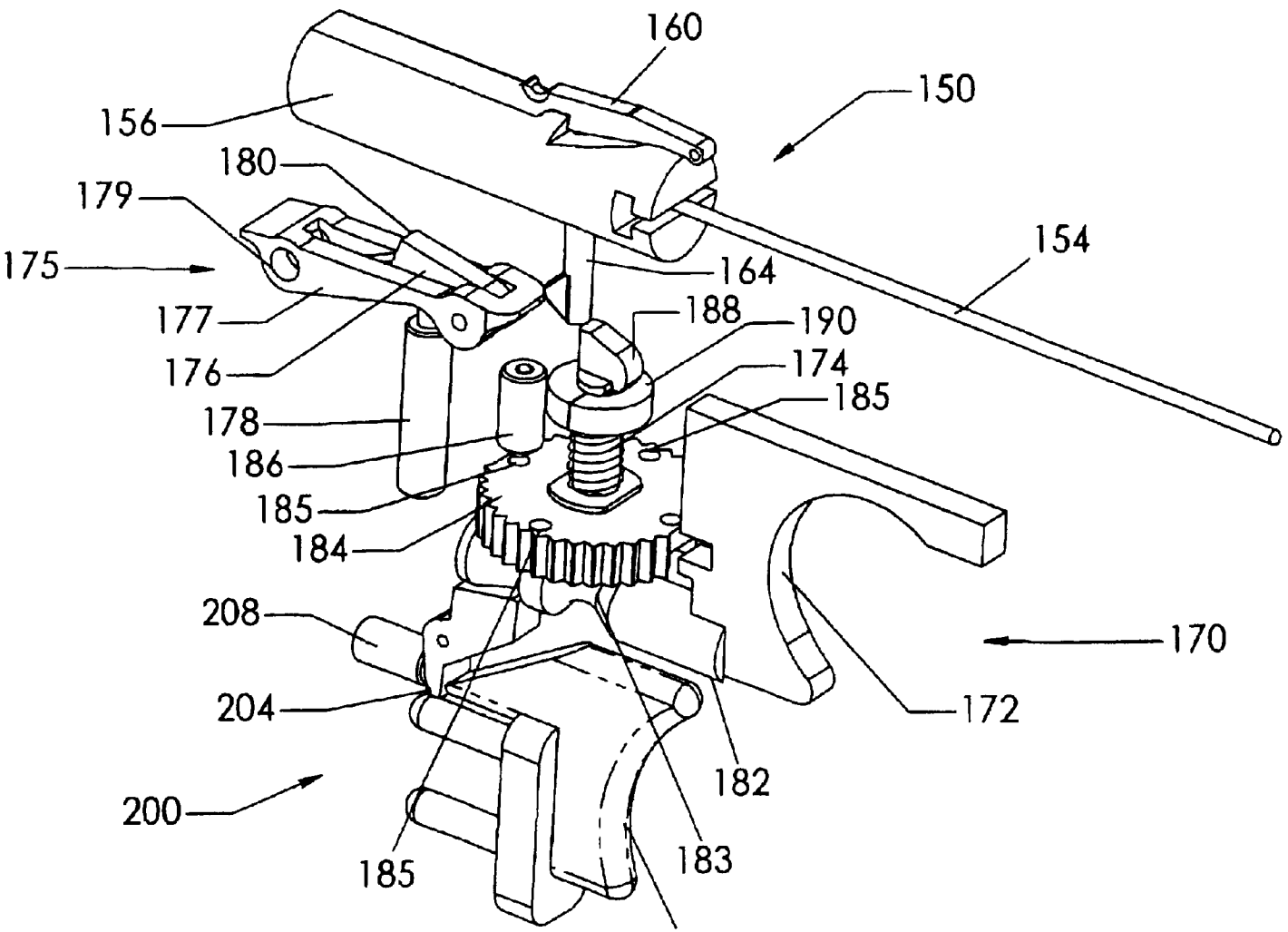
FIG. 9 illustrates a partial exploded perspective view of the trigger assembly according to an embodiment of the invention.

Referring to FIGS. 9 and 10 the safety knob 184 may have knob detents 185 other than at the opposing 180° locations described above, as for example, at a 90° position. This position of the safety knob 184 may prevent firing of the gun 10 if the top portion of the trigger actuating pin 174 is shaped such that there is no contact with the firing actuator pin 164, the trigger actuator pin 174 is indexed such that it may not be urged upward when at a 90° position or other angular position other than the opposing 180° positions for semiautomatic and automatic firing. There may be no trigger slots 187 at other than the opposing 180° positions that prevent trigger 172 from moving trigger rod 182 rearwardly by stopping trigger 172 on the outside circumference of safety knob 184 thus preventing trigger actuator pin 174 from any upward movement.

Referring again to FIGS. 6, 9 and 10 the gun 10 may have a safety trigger mechanism 200 with a safety trigger 202 located adjacent to the trigger 172 in the handle element 20 retained by trigger housing 22. There may be a safety trigger catch 204 located to engage a safety lug 206 of the trigger rod 182 to prevent rearward movement thereof. The safety trigger catch 204 may be biased in the engaged position by a safety catch ball plunger 208. When the safety trigger 202 may be moved rearwardly, the safety trigger catch 204 may be moved to disengage from the safety lug 206 thereby enabling the pulling of the trigger 172.

Referring to FIGS. 13 through 16, the gun 10 may have a gas pressure adjustment assembly 220 rotatably attached to the rearward portion of the handle element 20 for adjustment of the compression ratio of a contained gas. The handle element 20 may have an annular adjustment slot 222 with lug openings 224. Three are illustrated in the Figures as formed therein approximately 120 degrees apart in radial separation. The gas pressure adjustment assembly 220 may be generally shaped as a cylinder gas pressure handle 221 having an open end 230 for insertion over the rear portion of the receiver element 70. The open end 230 may have locking lugs 232 of which three are illustrated positioned for cooperative insertion through lug openings 224 to then engage the annular adjustment slot 222 when the gas pressure handle 221 may be rotated 360 degrees about the receiver element 70.

There may be a lug release lever 226 located at one of the lug openings 224 to inhibit an unintended disengagement of the gas pressure handle 221. The lug release lever 226 may have a protrusion 227 for insertion into a lug opening 224. The lug release lever 226 may be biased to close the lug opening 224 by release lever spring 228.

The gas pressure adjustment assembly 220 may have a rotatable rod 240 threadably engaged with a centrally disposed opening 244 in the receiver cap 80 with threads 242. The gas pressure handle 221 may have a rod retainer slot 246 formed therein for receipt of a rod retainer screw 248 to be threadably engaged with the rod 240 at a rearward end thereof. There may be indicator marks 247 to guide the operator regarding gas pressure adjustment. With the rod retainer screw 248 engaged with the rod 240 as the gas pressure handle 221 may be rotated about the receiver element 70, the rod 240 may be moved rearwardly and forwardly by the threaded engagement with the receiver cap 80. A cylindrical shaped rod slot 250 may be formed in the gas pressure handle 221 to provide space for the movement of rod 240.

There may be a gas chamber adjustment disc 252 slidably disposed in the gas chamber 74. The adjustment disc 252 may be in contact with gas chamber spring 76 that may apply rearward force against the adjustment disc 252. The rod 240 may be slidably inserted in a disc aperture 254 to control the rearward motion of the adjustment disc 252. The rotation of the rod 240 and the axial translation thereof may be used to move the adjustment disc 252 within the gas chamber 74 thereby causing a change in compression ratio or in volume and captured gas pressure. This adjustment may allow the operator to quickly, easily and safely change the rate of fire or rounds per minute of the gun. This may also allow the operator to compensate for differing types of ammunition. The adjustment disc 252 may have an annular slot 120 and a sealing ring 122 to inhibit the escape of gas similar to that of the bolt carrier plug 102.

The gas pressure adjustment assembly 220 may be easily removed by rotation thereof to move the rod 240 to the rearward most position. Then the lug release lever 226 may be engaged to release the locking lugs 232 from the annular adjustment slot 222. Finally, the gas pressure adjustment assembly 220 may be rotated to threadably disengage the rod 240 from the receiver cap 80 and then slide the gas pressure adjustment assembly 220 off the receiver element 70. A reversal of the process may be used for assembly.

While the gas pressure adjustment assembly 220 may have been described in terms of a gun, it may also be used in other applications requiring gas pressure adjustments while using a machine, i.e., one example may be for a jack hammer, pneumatic nail gun, air pump or like device wherein the receiver element may be part of the jackhammer and have a chamber formed therein with a piston slidably inserted.

Figure 17:
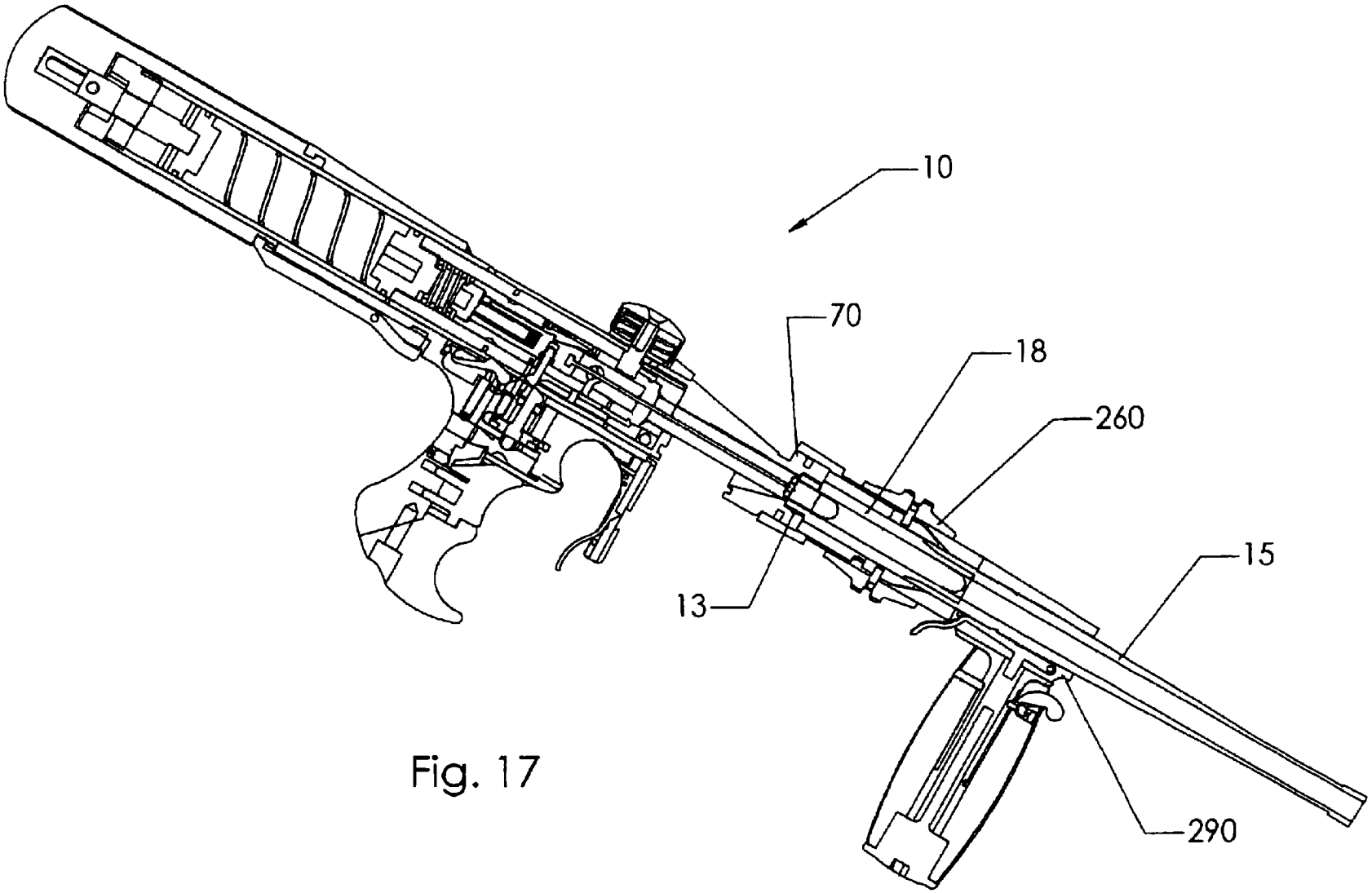
FIG. 17 illustrates a right side cross sectional view of the gun according to an embodiment of the invention.
Figure 18:
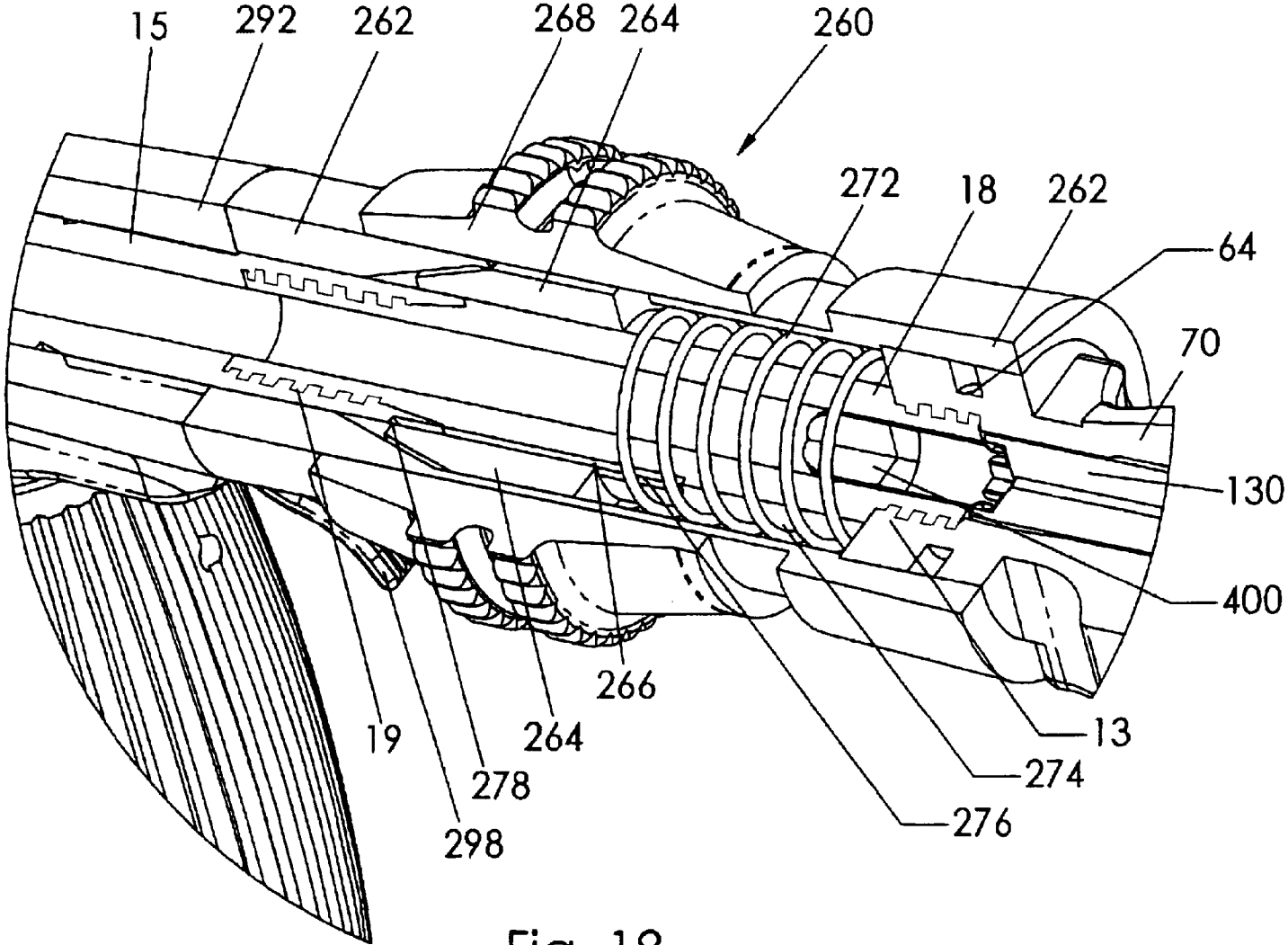
FIG. 18 illustrates a partial perspective cross sectional view of the barrel locking mechanism according to an embodiment of the invention.

Referring to FIGS. 17 and 18, the gun 10 may have a barrel or a barrel extension 15 engaged with a chamber barrel 18 that is intermediate the barrel extension 15 and the receiver element 70. The chamber barrel 18 may be threadably engaged with the receiver element 70 at threads 13. There may be a barrel locking mechanism 260 that may include quick release and safety elements attached to the receiver element 70 and enclosing the chamber barrel 18. The barrel extension 15 may be threadably engageable by threads 19 with the chamber barrel 18 and attachment of the barrel extension 15 may be assisted by a barrel engagement assembly 290 attached to the barrel extension 15.

Figure 19:
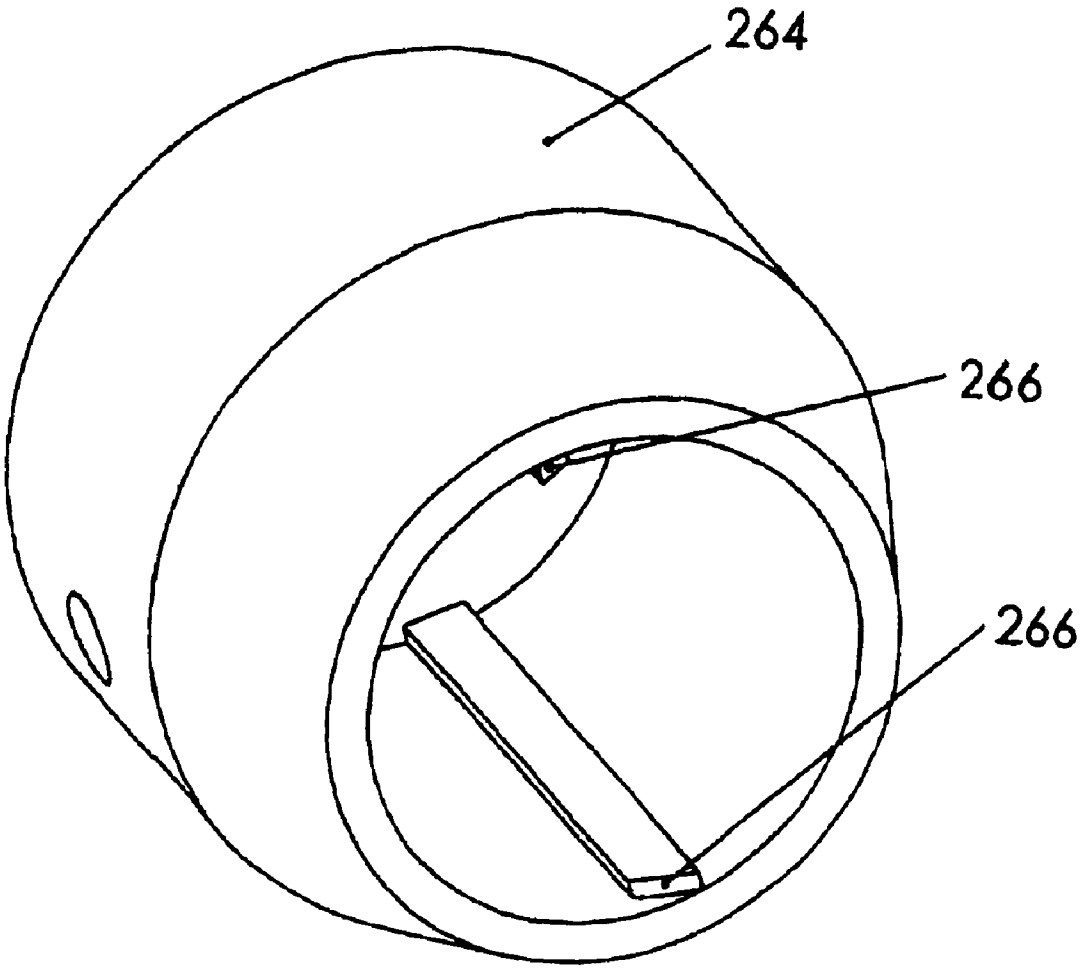
FIG. 19 illustrates perspective view of the locking sleeve according to an embodiment of the invention.
Figure 20:
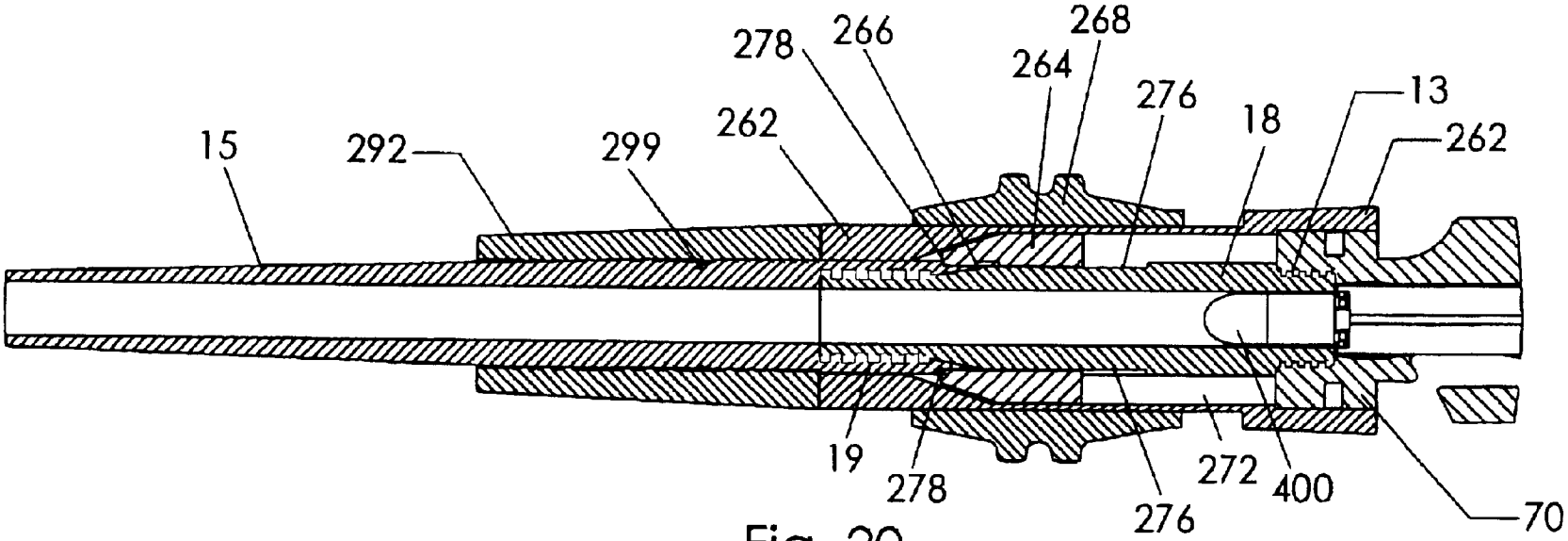
FIG. 20 illustrates a partial top cross sectional view of the barrel locking mechanism according to an embodiment of the invention.

Referring to FIGS. 18 through 20, the barrel locking mechanism 260 may have sleeve 262 attached to the receiver element 70. Disposed within the sleeve 262 may be a locking sleeve 264 having one or more locking lugs 266 of which two locking lugs 266 are illustrated, as best viewed in FIG. 19, that may be attached to an annular locking collar 268 with locking dowels 270. The locking lugs 266 may be of different shape to allow engagement in only one orientation that may facilitate that the barrel extension 15 may be correctly tightened in position. A barrel locking spring 272 may be disposed in annular locking cavity 274 to urge the locking sleeve 264 forwardly for locking lugs 266 to simultaneously engage chamber barrel locking cavities 276 and barrel locking cavities 278.

Figure 21:
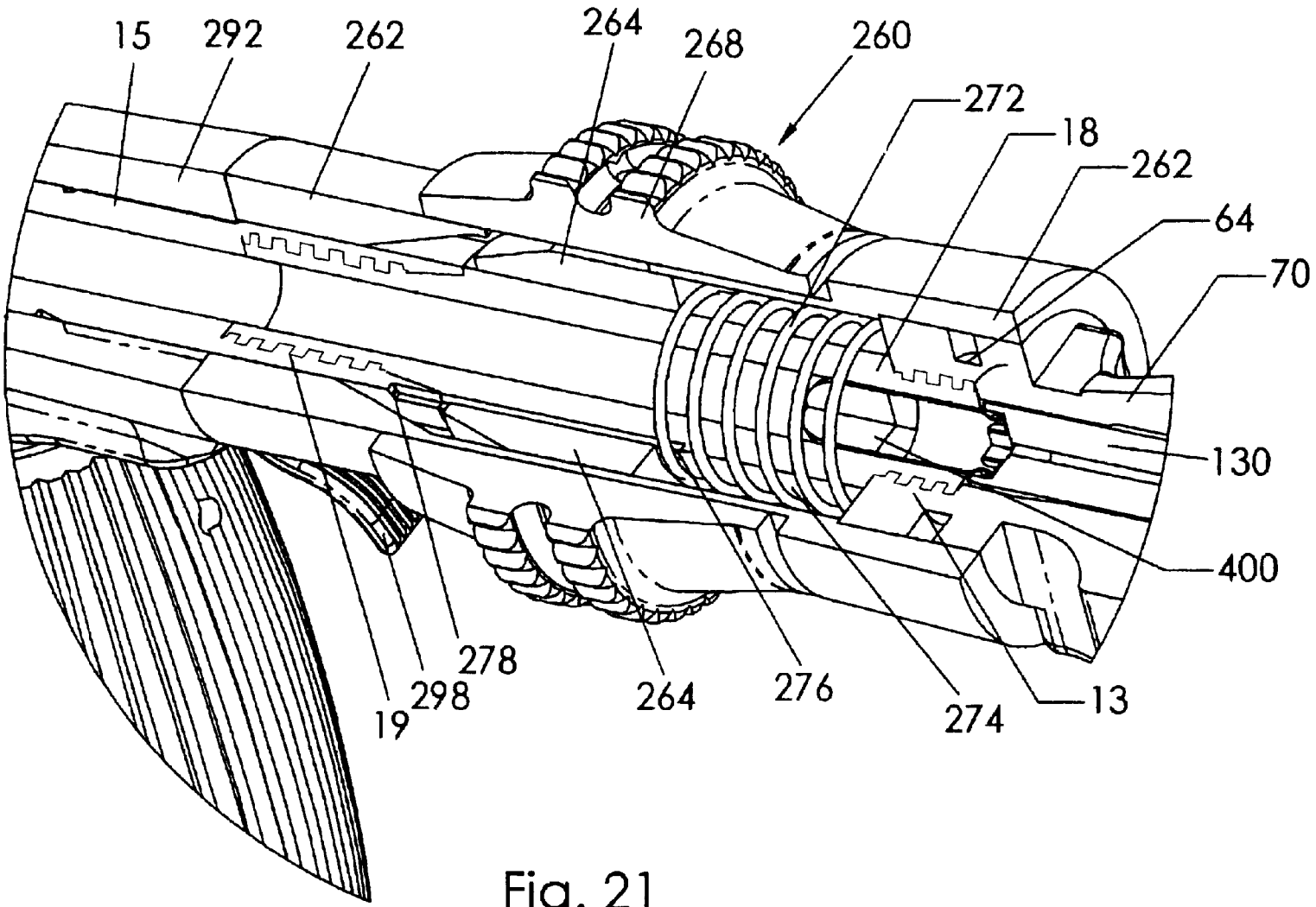
FIG. 21 illustrates a partial perspective cross sectional view of the barrel locking mechanism according to an embodiment of the invention.
Figure 22:
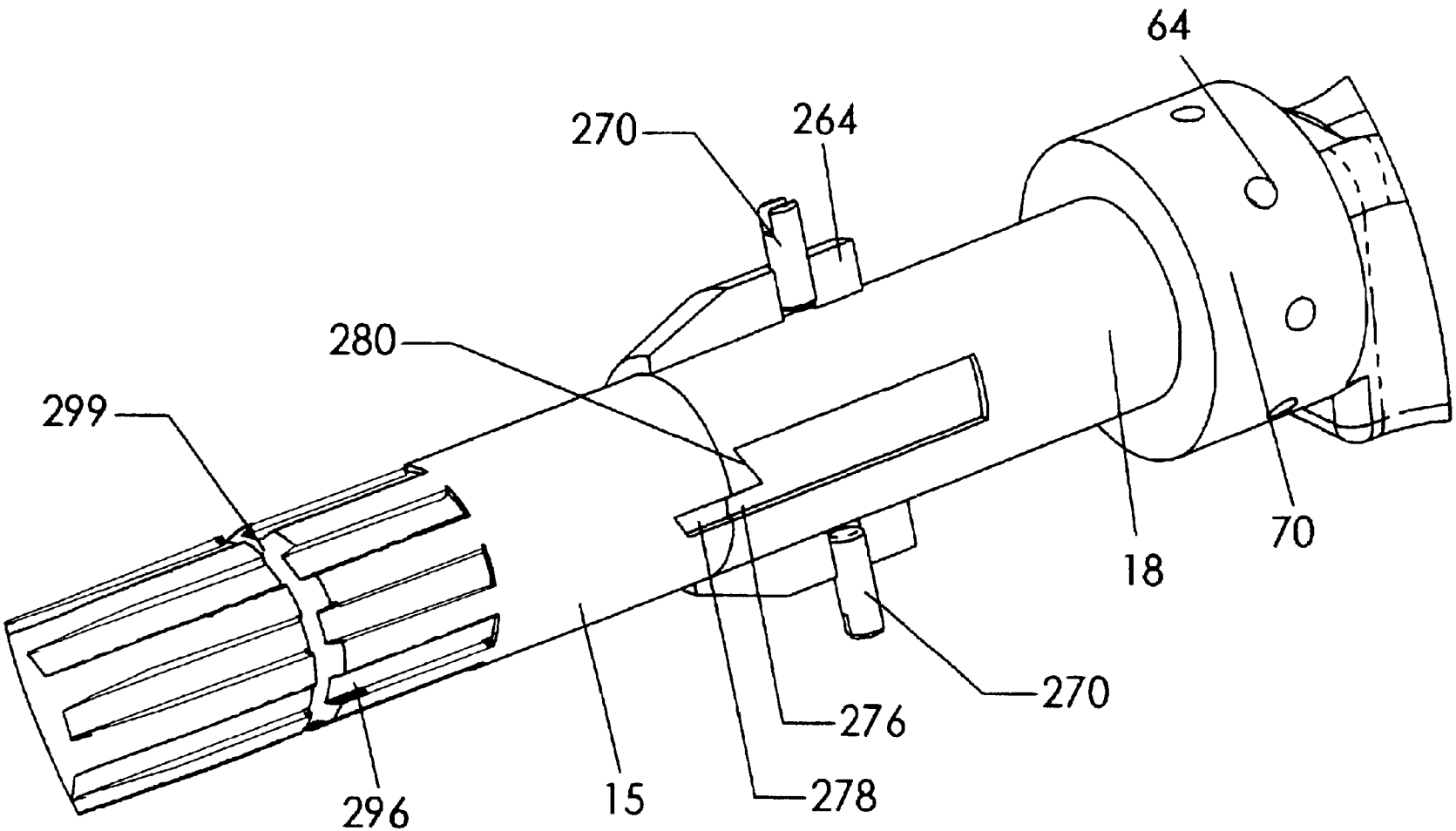
FIG. 22 illustrates a partial perspective view of the barrel elements according to an embodiment of the invention.

Referring to FIGS. 21 and 22, the barrel locking mechanism 260 may be disengaged by moving the locking collar 268 rearwardly and rotating to disengage locking lugs 266 from barrel locking cavities 278. The locking collar 268 may be rotated about sleeve 262 while in the rearward position to position locking lugs 266 in retainer cavities 280. The barrel extension 15 may then be rotated by using assembly 290 to disengage and remove it from chamber barrel 18. The reverse operation may be performed to engage and lock a barrel extension 15 to chamber barrel 18. Chamber barrel 18 may be attached to the receiver element 70 by barrel and receiver threads 13.

Referring to FIGS. 22 through 25, a barrel foregrip engagement assembly 290 may have a barrel sleeve 292 and attached handle assembly 300. The barrel sleeve 292 may also be used for attachment of a tripod, telescope, laser or like device for operation of the gun. The barrel sleeve 292 may have sleeve splines 294 for engagement with barrel splines 296. When the handle sleeve 292 is slidably engaged with the barrel extension 15, the handle assembly 300 may be used to aid in threadably engaging and disengaging the barrel extension 15 with the chamber barrel 18. This may allow for simple replacement of one barrel with another, for example, a short barrel for a long barrel. The barrel sleeve 292 may be retained on the barrel extension 15 by barrel sleeve lever 298 having a barrel sleeve lever catch 295 engaging barrel sleeve slot 299.

The handle assembly 300 may have handle arm 302 radiating general perpendicularly from sleeve 262. There may be a handle 310 having handle bore 311 slidably engaged with the handle arm 302. The handle 310 may be retained on the handle arm 302 by engagement of handle alignment pin 312 and handle lock pin 314 engaging in handle arm slots 304.

Figure 23:
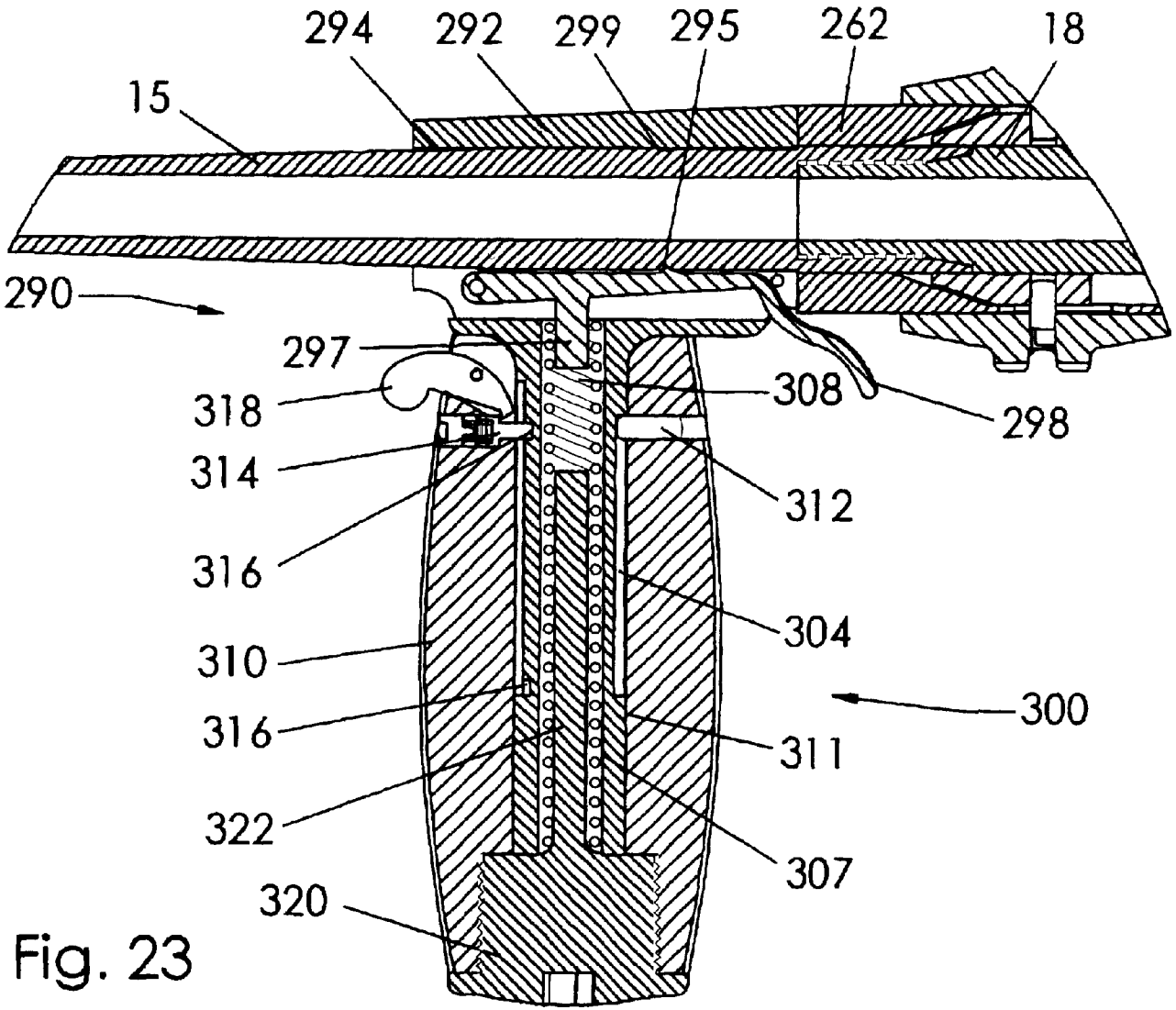
FIG. 23 illustrates a partial left side cross sectional elevation view of the barrel locking mechanism and the barrel engagement assembly according to an embodiment of the invention.
Figure 24:
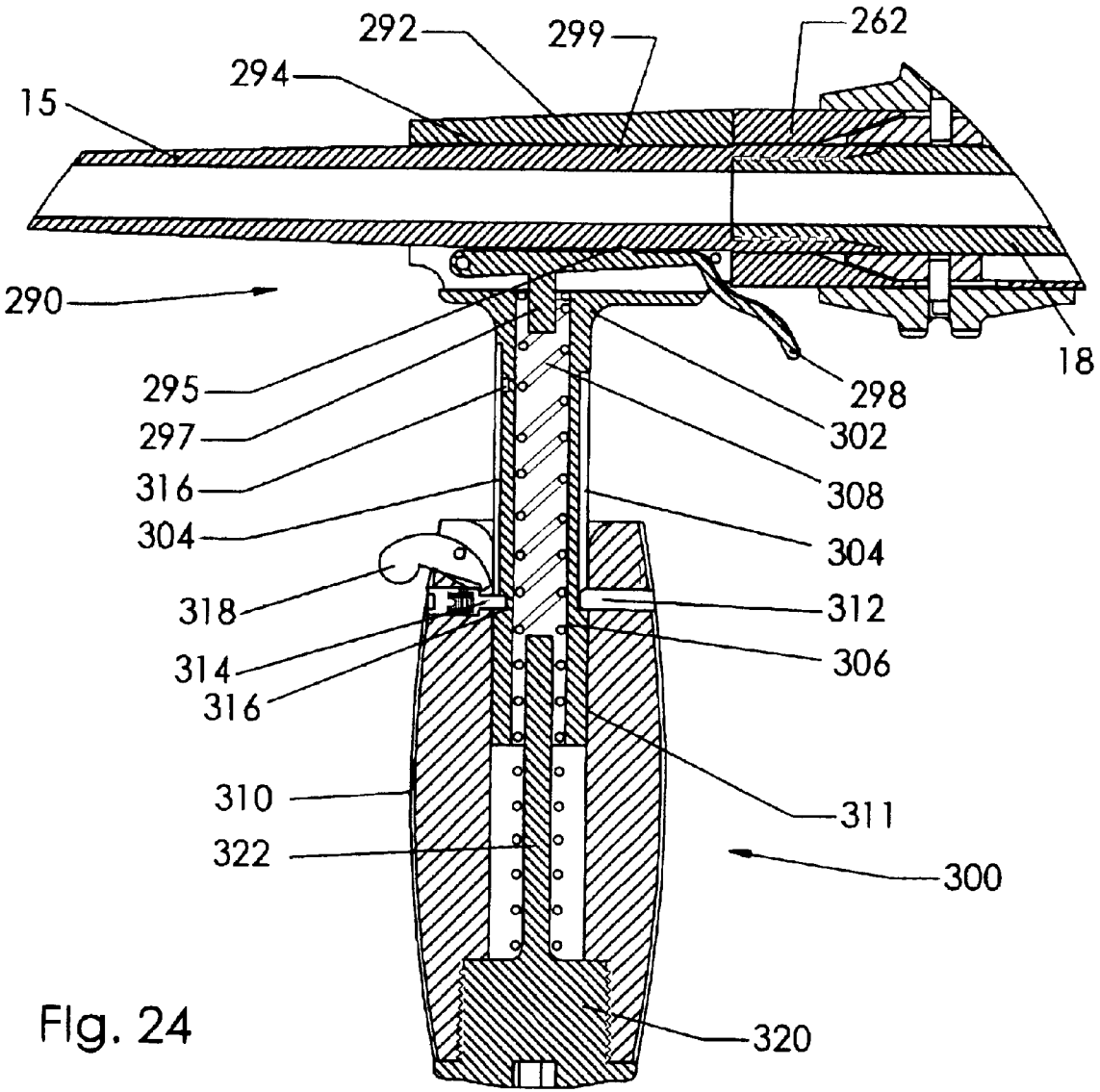
FIG. 24 illustrates a partial left side cross sectional elevation view of the barrel locking mechanism and the barrel engagement assembly according to an embodiment of the invention.
Figure 25:
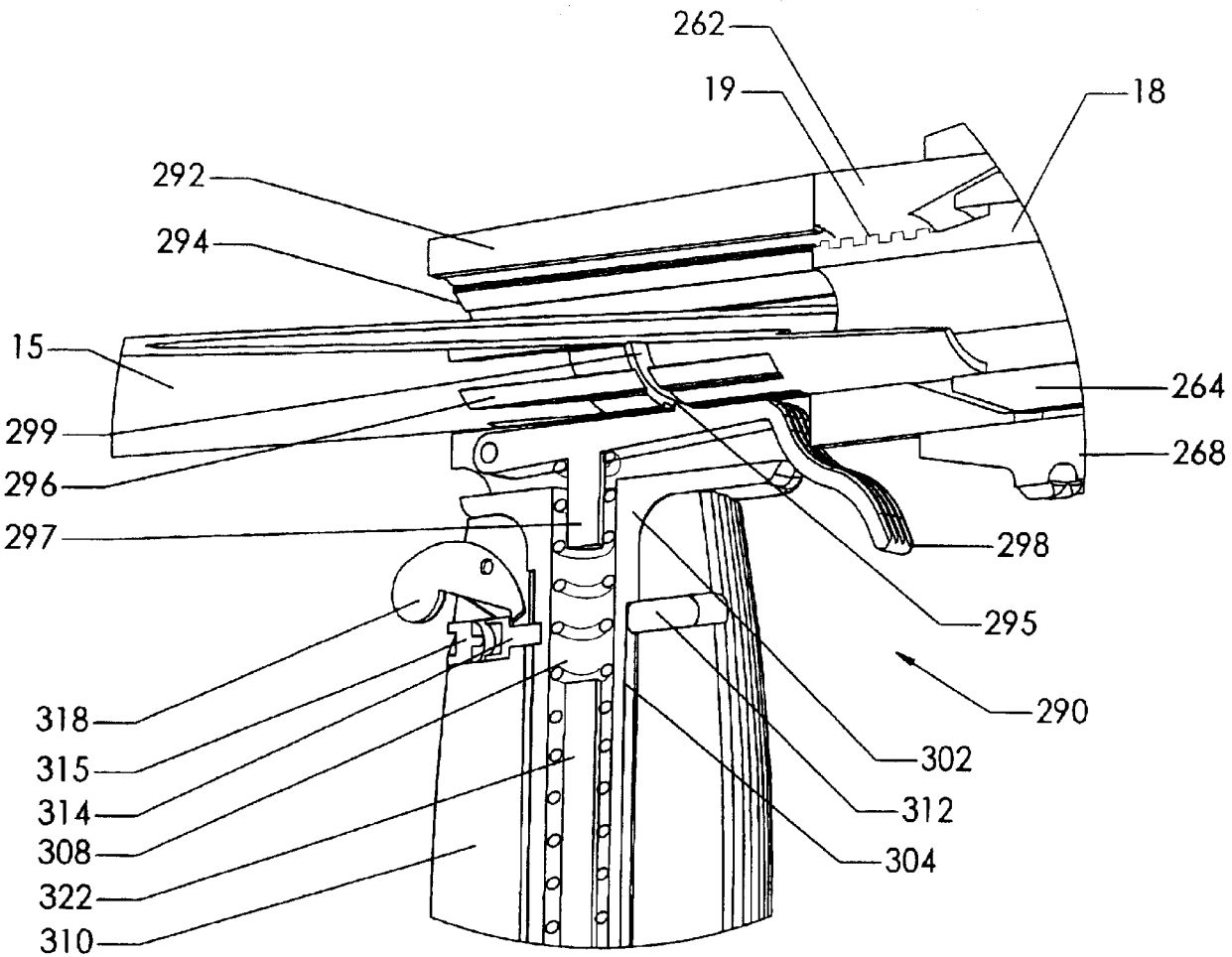
FIG. 25 illustrates a partial left side perspective cross sectional elevation view of the barrel engagement assembly according to an embodiment of the invention.
Figure 26:
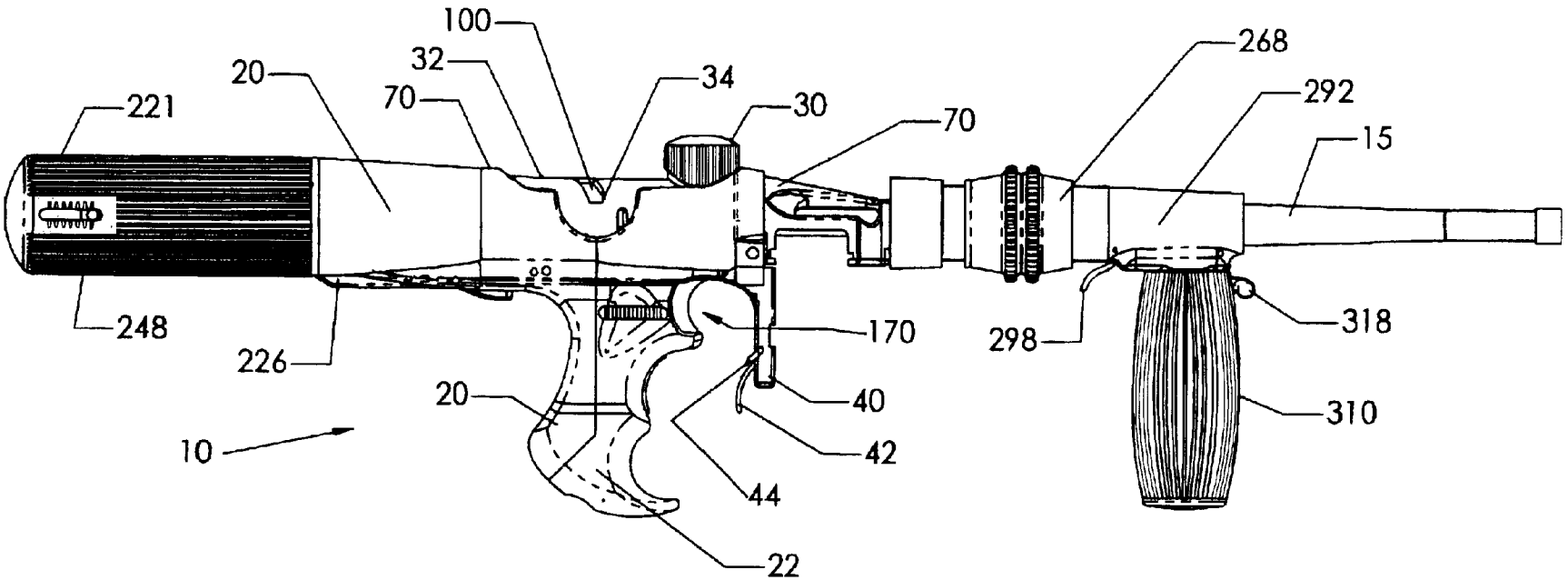
FIG. 26 illustrates a right side elevation view of the gun according to an embodiment of the invention.

The handle 310 may be moved between a closed position as illustrated in FIG. 23 to an open position as illustrated in FIG. 24. The handle 310 may be locked in either position by engagement of handle lock pin 314 that may have a bias spring (not shown) in a handle lock aperture 316. The handle lock pin 314 may be disengaged by manipulation of handle lock lever 318. The handle 310 may be moved to the open or extended position to provide an extended lever for use in threadably engaging and disengaging the barrel extension 15.

The handle arm 302 may have handle arm bore 306 with a handle arm spring 308 disposed therein between barrel sleeve lever 298 and handle insert 320. The handle arm spring 308 may apply spring force such that when handle locking lever 318 may be activated to release handle 310, the handle 310 may move outwardly from barrel sleeve 292. The barrel sleeve lever 298 may have a sleeve lever protrusion 297 for positioning the handle arm spring 308 and similarly the handle insert 320 may have a handle insert protrusion 322 for positioning the handle arm spring 308. The handle arm spring 308 may be biased to urge barrel sleeve lever 298 with barrel sleeve lever catch 295 to engage barrel sleeve slot 299.

While the invention has been particularly shown and described with respect to the illustrated embodiments thereof, it will be understood by those skilled in the art that the foregoing and other changes in form and details may be made therein without departing from the spirit and scope of the invention.

I claim:

1. A gun comprising:

a receiver element having a barrel extending forwardly from said receiver element, said barrel having a chamber end and a discharge end;

a handle element attached to said receiver element and a trigger assembly integrated with said handle element;

said receiver element having a bolt carrier chamber formed therein and a bolt carrier assembly slidably disposed in said bolt carrier chamber;

said bolt carrier chamber at a rearward portion thereof and said bolt carrier assembly defining a gas chamber wherein said bolt carrier chamber having a closure at a rearward end;

a bolt assembly slidably disposed in said bolt carrier assembly;

an actuator slidably engaged with said receiver element and said actuator engagable with said bolt carrier assembly and said bolt assembly;

a firing pin assembly slidably disposed in said bolt assembly and having a firing assembly in communication with said trigger assembly; and an ammunition source attachable to said receiver element.

2. The gun as in claim 1 wherein said ammunition source is a magazine that is attachable to a magazine attachment of said receiver element and there is a magazine retainer.

3. The gun as in claim 2 wherein there is a magazine release catch engagable with said magazine retainer.

4. The gun as in claim 1 wherein:

said handle element having a foregrip handle attached to a foregrip arm having a foregrip collar for rotational attachment at a forward portion of said receiver element;

a position pin engaged in said foregrip collar for insertion in said receiver element having a plurality of position holes formed therein.

5. The gun as in claim 4 wherein:

said foregrip arm having a foregrip pivot point at which said foregrip handle is rotationally attached and retained by a foregrip screw and a wing nut threaded thereon.

6. The gun as in claim 1 wherein there is a casing eject slot in said receiver element.

7. The gun as in claim 1 wherein there is a bullet chamber guide.

8. The gun as in claim 1 further comprising:

an actuator slidably engaged in an actuator slot of said receiver element;

said actuator having an actuator pin for engagement with said bolt carrier assembly and a cocking slot of said bolt assembly; and an actuator spring.

9. The gun as in claim 8 wherein there is an actuator lock slot in communication with said actuator slot.

10. The gun as in claim 1 wherein there is a gas chamber spring in said gas chamber.

11. The gun as in claim 1 wherein said receiver element having a gas port defined therein.

12. The gun as in claim 1 wherein said bolt carrier assembly further comprising:

a bolt catch engagable with a catch aperture in said receiver element; and a catch spring biased to force engagement of said bolt catch when said bolt catch is seated in a catch slot of said bolt assembly.

13. The gun as in claim 12 wherein said catch spring is an annular O-ring spring.

14. The gun as in claim 1 wherein said bolt carrier assembly having a bolt carrier plug with an annular ring defined therein and a sealing ring disposed in said annular ring.

15. The gun as in claim 14 wherein there is a bolt spring disposed between said bolt carrier plug and said bolt assembly.

16. The gun as in claim 1 wherein said bolt assembly having a chamber portion with a firing pin channel defined therein.

17. The gun as in claim 1 wherein said bolt assembly having a bolt plug with a bolt rod extending forwardly therefrom and a firing pin spring partially disposed on said bolt rod.

18. The gun as in claim 17 wherein said firing pin assembly having a firing pin housing with a housing bore defined therein for receipt of said bolt rod and said firing pin spring.

19. The gun as in claim 1 wherein said firing pin assembly comprising a firing pin housing and a firing pin.

20. The gun as in claim 1 wherein:

said firing pin assembly having a firing pin lug positioned for engagement with a firing pin sear in said bolt assembly;

a sear spring biased to urge engagement of said firing pin sear with said firing pin lug;

a firing actuator pin slidably engaged in said firing pin assembly and positioned to disengage said firing pin sear from said firing pin lug; and a firing actuator pin spring biased to urge said firing pin actuator away from said firing pin sear.

21. The gun as in claim 20 wherein said sear spring is an annular O-ring spring.

22. The gun as in claim 1 wherein:

a safety dowel is slidably engaged approximately perpendicular to a firing pin in said bolt assembly;

a dowel spring is biased to urge said safety dowel toward said firing pin to seat in a dowel aperture;

a dowel release pin slidably engaged approximately perpendicular to said safety dowel in said bolt assembly and retained by a dowel pin safety screw; and said safety dowel having a dowel slot defined therein for engagement therein of said dowel release pin to move said safety dowel against the force of said dowel spring.

23. The gun as in claim 22 wherein said dowel spring is an annular O-ring spring.

24. The gun as in claim 1 wherein said trigger assembly comprising:

a trigger engaged with a trigger rod slidably mounted in said trigger assembly;

said trigger rod having a trigger rod recess defined therein for engagement with a trigger actuation pin to urge said trigger actuation pin upwardly for engagement with a firing actuator pin when said trigger is pulled; and a trigger rod spring biased to urge said trigger rod against said trigger.

25. The gun as in claim 24 wherein:

said trigger actuation pin is slidably disposed in a safety knob and a trigger actuation pin guide;

a trigger actuation pin spring disposed between a trigger actuation pin step and said trigger actuation pin guide to urge said trigger actuation pin against said trigger rod;

said safety knob having a plurality of detents formed therein for engagement with a safety pin ball plunger; and said safety knob having a plurality of trigger slots formed therein for engagement by said trigger.

26. The gun as in claim 24 wherein said trigger actuation pin having a front nose element for slidable engagement with said firing actuator pin.

27. The gun as in claim 24 wherein a safety trigger mechanism having a safety trigger engaged with a safety trigger catch that engages in said trigger rod having a safety lug define therein and a safety catch ball plunger to urge said safety trigger catch to engage said safety lug.

28. The gun as in claim 1 wherein said trigger assembly comprising:

a roller cocking assembly having a cocking latch pivotally attached at one end to a cocking arm;

said cocking arm at an end opposite said cocking latch pivot attachment pivotally attached to said trigger assembly;

a cocking latch ball plunger biased to urge said cocking latch upwardly; and a cocking latch surface positioned to engage a firing actuator pin.

29. The gun as in claim 1 wherein a trigger housing retains said trigger assembly in said handle element.

30. The gun as in claim 1 wherein said closure is a receiver cap at the rearward end of said receiver element.

31. The gun as in claim 1 further comprising:

a gas pressure adjustment assembly having a rod threadably engaged with said closure having a centrally disposed opening therein;

an adjustment disc slidably disposed in said receiver element and having a disc aperture defined therein for slidable engagement with said rod.

32. The gun as in claim 31 wherein said gas pressure adjustment assembly having a rod retainer slot for receipt of a rod retainer screw to retain said rod for rotational motion of said rod when a gas pressure handle is rotated; and said gas pressure adjustment assembly having a rod slot.

33. The gun as in claim 32 wherein said retainer slot having a plurality of indicator marks adjacent thereto.

34. The gun as in claim 31 wherein:

said gas pressure adjustment system having a plurality of locking lugs at an open end thereof;

said handle element having an annular adjustment slot defined therein wherein there are a plurality of lug openings define for receipt of said locking lugs; and a lug release lever in said handle element having a protrusion for closure of one of said lug openings.

35. The gun as in claim 1 wherein:

said receiver element having a sleeve attached thereto and said sleeve enclosing a chamber barrel threadably engaged with said receiver element wherein said barrel is threadably engaged with said chamber barrel;

a locking sleeve disposed within said sleeve, slidably engaged with said chamber barrel and slidably engageable with said barrel;

said locking sleeve having a locking lug slidably engaged in a chamber barrel locking cavity and slidably engageable in a barrel locking cavity;

a locking collar attached to said locking sleeve by a locking dowel; and a barrel locking spring disposed in an annular locking cavity between said locking sleeve and said receiver element.

36. The gun as in claim 35 wherein there is a retainer cavity for engagement with said locking lug.

37. The gun as in claim 35 wherein:

a barrel sleeve may be slidably engaged annularly around said barrel and retained by a barrel sleeve lever having a barrel lever catch engaging a barrel sleeve slot; and a handle assembly attached to and protruding generally perpendicularly from said handle sleeve.

38. The gun as in claim 35 wherein a barrel sleeve may be slidably engaged annularly around said barrel and retained by a barrel sleeve lever having a barrel lever catch engaging a barrel sleeve slot.

39. The gun as in claim 38 wherein one of a tripod, telescope and laser may be attached to said barrel sleeve.

40. The gun as in claim 35 wherein said barrel sleeve and said barrel having a plurality of splines formed therein for slidable engagement.

41. The gun as in claim 35 wherein said handle assembly comprising:

a handle arm with a handle slidably engaged thereon;

said handle retained on said handle arm by a handle alignment pin and a handle lock pin retained in said handle and in a handle arm slot; and said handle retained in position by insertion of said handle lock pin in a handle lock aperture.

42. The gun as in claim 41 wherein there is a handle lock lever engaged with said handle lock pin.

43. The gun as in claim 41 wherein:

said handle arm having a handle arm bore with a handle arm spring disposed therein;

a handle insert in said handle and having a handle insert protrusion for positioning said handle arm spring; and said sleeve lever having a sleeve lever protrusion for engaging said handle arm spring.

44. A gun comprising:

a receiver element having a barrel extending forwardly from said receiver element, said barrel having a chamber end and a discharge end;

a handle element attached to said receiver element and a trigger assembly integrated with said handle element;

said receiver element having a bolt carrier chamber formed therein and a bolt carrier assembly slidably disposed in said bolt carrier chamber;

said bolt carrier chamber at a rearward portion thereof and said bolt carrier assembly defining a gas chamber;

a bolt assembly slidably disposed in said bolt carrier assembly;

an actuator slidably engaged with said receiver element and said actuator engagable with said bolt carrier assembly and said bolt assembly;

a firing pin assembly slidably disposed in said bolt assembly and having a firing assembly in communication with said trigger assembly;

a receiver cap at the rearward end of said receiver element;

a gas pressure adjustment assembly having a rod threadably engaged with said receiver cap having a centrally disposed opening therein;

an adjustment disc slidably disposed in said receiver element and having a disc aperture defined therein for slidable engagement with said rod;

said gas pressure adjustment assembly having a rod retainer slot for receipt of a rod retainer screw to retain said rod for rotational motion of said rod;

said gas pressure adjustment assembly having a rod slot;

said gas pressure adjustment system having a plurality of locking lugs at an open end thereof;

said handle element having an annular adjustment slot defined therein wherein there are a plurality of lug openings define for receipt of said locking lugs;

a lug release lever in said handle element having a protrusion for closure of one of said lug openings; and an ammunition source attachable to said receiver element.

45. A gas pressure adjustment system for use with a gas operated recoil machine comprising:

a receiver element having a chamber formed therein and a piston slidably disposed in said chamber;

said chamber at a rearward portion thereof and said piston defining a gas chamber;

a receiver cap at the rearward end of said receiver element;

a gas pressure adjustment assembly having a rod threadably engaged with said receiver cap having a centrally disposed opening therein;

an adjustment disc slidably disposed in said receiver element and having a disc aperture defined therein far slidable engagement with said rod;

said gas pressure adjustment assembly having a rod retainer slot for receipt of a rod retainer screw to retain said rod for rotational motion of said rod;

said gas pressure adjustment assembly having a rod slot;

said gas pressure adjustment system having a plurality of locking lugs at an open end thereof;

a handle element having an annular adjustment slot defined therein wherein there are a plurality of lug openings defined for receipt of said locking lugs; and a lug release lever in said handle element having a protrusion for closure of one of said lug openings.

* * * * *